US007524248B2

(12) United States Patent
Kumamoto

(10) Patent No.: US 7,524,248 B2
(45) Date of Patent: Apr. 28, 2009

(54) SHAFT FOR GOLF CLUBS AND GOLF CLUB

(75) Inventor: Tomio Kumamoto, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 0 days.

(21) Appl. No.: 11/882,535

(22) Filed: Aug. 2, 2007

(65) Prior Publication Data

US 2008/0070716 A1 Mar. 20, 2008

(30) Foreign Application Priority Data

Sep. 19, 2006 (JP) ..... 2006-252088
Dec. 14, 2006 (JP) ..... 2006-337326

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 5,439,219 A * 8/1995 Vincent ..... 473/319
6,117,021 A * 9/2000 Crow et al. ..... 473/289
6,322,458 B1 * 11/2001 Kusumoto et al. ..... 473/316
6,485,376 B1 * 11/2002 Hisamatsu ..... 473/319
6,652,389 B2 * 11/2003 Hisamatsu et al. ..... 473/319
7,025,691 B2 * 4/2006 Matsumoto et al. ..... 473/316
2004/0033667 A1 2/2004 Lee
2005/0020375 A1 * 1/2005 Matsumoto et al. ..... 473/313
2006/0211510 A1 * 9/2006 Ashida et al. ..... 473/316
2008/0070716 A1 * 3/2008 Kumamoto ..... 473/289

FOREIGN PATENT DOCUMENTS

JP 2002177423 6/2002
JP 2003-169871 A 6/2003
JP 2004033667 2/2004
JP 2005-34550 A 2/2005
WO WO-2005065785 7/2005

* cited by examiner

*Primary Examiner*—Stephen L. Blau
(74) *Attorney, Agent, or Firm*—Birch, Stewart, Kolasch & Birch, LLP

(57) ABSTRACT

Points obtained by plotting flexural rigidity EI measured at ten sites on a shaft are defined as from T (1) to T (10) in this order from the head side, and the formula representing a line K that passes the T (1) and the T (10) is defined as [Y=aX+b1]. The values at the Y-intercepts on the lines that are parallel to the line K and that pass the points of from T (2) to T (9), respectively, are defined as from b2 to b9, respectively, and the minimum value among the values at the Y-intercepts b2 to b9 is defined as bmin. Slope "a" of the line K is 0.04 or greater and 0.06 or less; every one of the b3, b4, b5, b6, b7 and b8 is smaller than b1; and the bmin is any one of b4 to b7. The value (b1−bmin) is 30 ($N \cdot m^2$) or greater and 40 ($N \cdot m^2$) or less, and the value (b9−b1) is 4 ($N \cdot m^2$) or greater and 15 ($N \cdot m^2$) or less. This shaft either has a high-strength straight layer and a hoop layer, or has a textile layer.

6 Claims, 11 Drawing Sheets

SHAFT FOR GOLF CLUBS AND GOLF CLUB

This application claims priority on Patent Application No. 2006-252088 filed in JAPAN on Sep. 19, 2006, and Patent Application No. 2006-337326 filed in JAPAN on Dec. 14, 2006. The entire contents of these Japanese Patent Applications are hereby incorporated by reference.

BACKGROUND OF THE INVENTION

1. Field of the Invention

The present invention relates to shafts for golf clubs and golf clubs.

2. Description of the Related Art

In recent years, carbon shafts, which are generally referred to, have been used as the shafts for golf clubs. In the carbon shafts, carbon fiber having high specific strength and specific rigidity has been used. As the specific strength and specific rigidity of the carbon fiber increases, manufacture of lightweight shafts for golf clubs has been enabled.

During swing, the shaft is bent or twisted. Behavior of the shaft during swing may vary depending on rigidity distribution of the shaft. JP-A-2003-169871 and JP-A-2005-34550 disclose a shaft manufactured taking into consideration of the rigidity distribution. The invention described in JP-A-2003-169871 specifies rigidity at a tip part of the shaft. JP-A-2005-34550 specifies a position where minimum flexural rigidity is provided.

SUMMARY OF THE INVENTION

Even in the case of the invention according to the aforementioned prior art, satisfactory flight distance and directionality of the hit ball could not be attained. The present inventor found another technical problems potentially accompanied by the prior arts. The present invention solves such technical problems by a technical idea which is quite different from that in the aforementioned prior art. According to the present invention, a shaft which can improve the flight distance and the directionality of hit balls can be provided. The present invention was made taking into consideration of the behavior the shaft during swing in detail, distinct from the aforementioned prior art. According to the present invention, a novel operational benefit which could not be conventionally expected can be provided.

Japanese Patent Application No. 2006-177457 defines a value (b1−bmin) similarly to the present invention. In Japanese Patent Application No. 2006-177457, the value (b1−bmin) was set to be 24 ($N\cdot m^2$) or greater and 35 ($N\cdot m^2$) or less. When the value (b1−bmin) is grater than 35 ($N\cdot m^2$), strength of the shaft may be insufficient.

In one aspect of the present invention (first invention), a fiber reinforced resin layer in which a carbon fiber having a high strength is oriented substantially parallel to the shaft axis direction is combined with a fiber reinforced resin layer in which a carbon fiber is oriented substantially orthogonal to the shaft axis direction. According to this construction, the shaft of the present invention (first invention) can retain the strength even if the value (b1−bmin) is large, and a shaft that is excellent in feeling can be provided.

In another aspect of the present invention (second invention), a textile in which a carbon fiber is oriented in the shaft axis direction and the direction orthogonal thereto is used. According to this construction, the shaft of the present invention (second invention) can retain the strength even if the value (b1−bmin) is large, and a shaft that is excellent in feeling can be provided.

The present invention can provide a golf club that is particularly suited for less powerful golf players. The invention disclosed in Japanese Patent Application No. 2006-177457 is particularly suited for golf players who attain the head speed with a driver of 40 to 45 m/s. To the contrary, the present invention is particularly suited for less powerful golf players who attain the head speed with a driver of 30 to 35 m/s because the (b1−bmin) is comparatively large. For such less powerful golf players, shafts that are more apt to be bent than the shaft disclosed in Japanese Patent Application No. 2006-177457 are suitable. According to the present invention, sufficient bending can be achieved by golf players who attain a low head speed.

An object of the present invention is to provide a shaft for golf clubs and a golf club that achieve excellent flight distance performance and directionality of the hit ball.

In the shaft for golf clubs according to the present invention, a position 130 mm away from the head-side end of the shaft is defined as a first position, a position 130 mm away from the grip-side end of the shaft is defined as a tenth position, and positions provided by equally dividing the length between the first position and the tenth position into nine regions are defined as a second position, a third position, a fourth position, a fifth position, a sixth position, a seventh position, an eighth position and a ninth position in this order from the head side. Each flexural rigidity EI measured at the ten sites of from the first position to the tenth position is defined as EI (1), EI (2), EI (3), EI (4), EI (5), EI (6), EI (7), EI (8), EI (9) and EI (10) in this order from the head side. Furthermore, each point obtained by plotting the measurement values at the positions of ten sites on an X-Y coordinate plane, in which the X-axis represents the distance (mm) to the measurement position from the head-side end and the Y-axis represents the value of flexural rigidity EI ($N\cdot m^2$), is defined as T (1), T (2), T (3), T (4), T (5), T (6), T (7), T (8), T (9) and T (10) in this order from the head side. The formula representing a line K that passes the T (1) and the T (10) on the X-Y coordinate plane is defined as [Y=aX+b1]. The values ($N\cdot m^2$) at the Y-intercepts on the lines that are parallel to the aforementioned line K and that pass the aforementioned points of T (2), T (3), T (4), T (5), T (6), T (7), T (8) and T (9), respectively, are defined as b2, b3, b4, b5, b6, b7, b8 and b9, respectively. The minimum value among the values at the Y-intercepts b2 to b9 is defined as bmin.

In the shaft for golf clubs according to the present invention, the slope "a" of the line K is set to be 0.04 or greater and 0.06 or less. Every one of the b3, b4, b5, b6, b7 and b8 is smaller than b1. The bmin is any one of b4, b5, b6 or b7. The value (b1−bmin) is set to be 30 ($N\cdot m^2$) or greater and 40 ($N\cdot m^2$) or less. The value (b9−b1) is set to be 4 ($N\cdot m^2$) or greater and 15 ($N\cdot m^2$) or less.

Furthermore, the shaft for golf clubs of the present invention satisfies the following requirement (A) or (B).

(A): The shaft has at least one straight layer disposed along the overall length thereof, at least one hoop layer disposed along 50% or more of shaft overall length, the straight layer and the hoop layer includes a carbon fiber reinforced resin, tensile strength of the carbon fiber constituting the straight layer is 580 $kgf/mm^2$ or greater and 680 $kgf/mm^2$ or less, and the strength at point B with SG three-point flexural strength is equal to or greater than 60 kgf.

(B) At least one textile layer having warps and wefts of a carbon fiber is provided, one of the warp and weft is oriented substantially to the shaft axis direction, while another of the warp and weft is oriented substantially to the orthogonal direction with respect to the shaft axis direction, and the tensile strength of the carbon fiber constituting the textile layer is 300 kgf/mm$^2$ or greater and 680 kgf/mm$^2$ or less.

Preferably, textile of the textile layer is plain-woven.

In the present invention, the minimum value among from EI (1) to EI (10) is defined as E1, and the maximum value among from EI (1) to EI (7) is defined as E2. Preferably, E1 is EI (2), EI (3), EI (4) or EI (5). The value E1 is preferably 12 (N·m$^2$) or greater and 20 (N·m$^2$) or less. The value (E2−E1) is preferably equal to or less than 30 (N·m$^2$). The value EI (10) is preferably 60 (N·m$^2$) or greater and 90 (N·m$^2$) or less.

Preferably, the overall length of the shaft is equal to or greater than 43 inches. Preferably, shaft weight of the shaft is 30 g or greater and 50 g or less. Preferably, the forward flex of the shaft is 120 mm or greater and 160 mm or less.

BRIEF DESCRIPTION OF THE DRAWINGS

FIG. 6A shows a developed view illustrating pre-pregs of the shaft according to Examples and the like;

FIG. 6B shows a developed view illustrating pre-pregs of the shaft according to other Examples and the like;

DESCRIPTION OF THE PREFERRED EMBODIMENTS

Hereinafter, the present invention will be explained in detail by way of preferred embodiments with appropriate reference to the accompanying drawings.

The tensile strength and tensile modulus of elasticity of the fiber herein means the value measured in accordance with JIS R7601: 1986 "Testing methods for carbon fibers".

Figure 1:
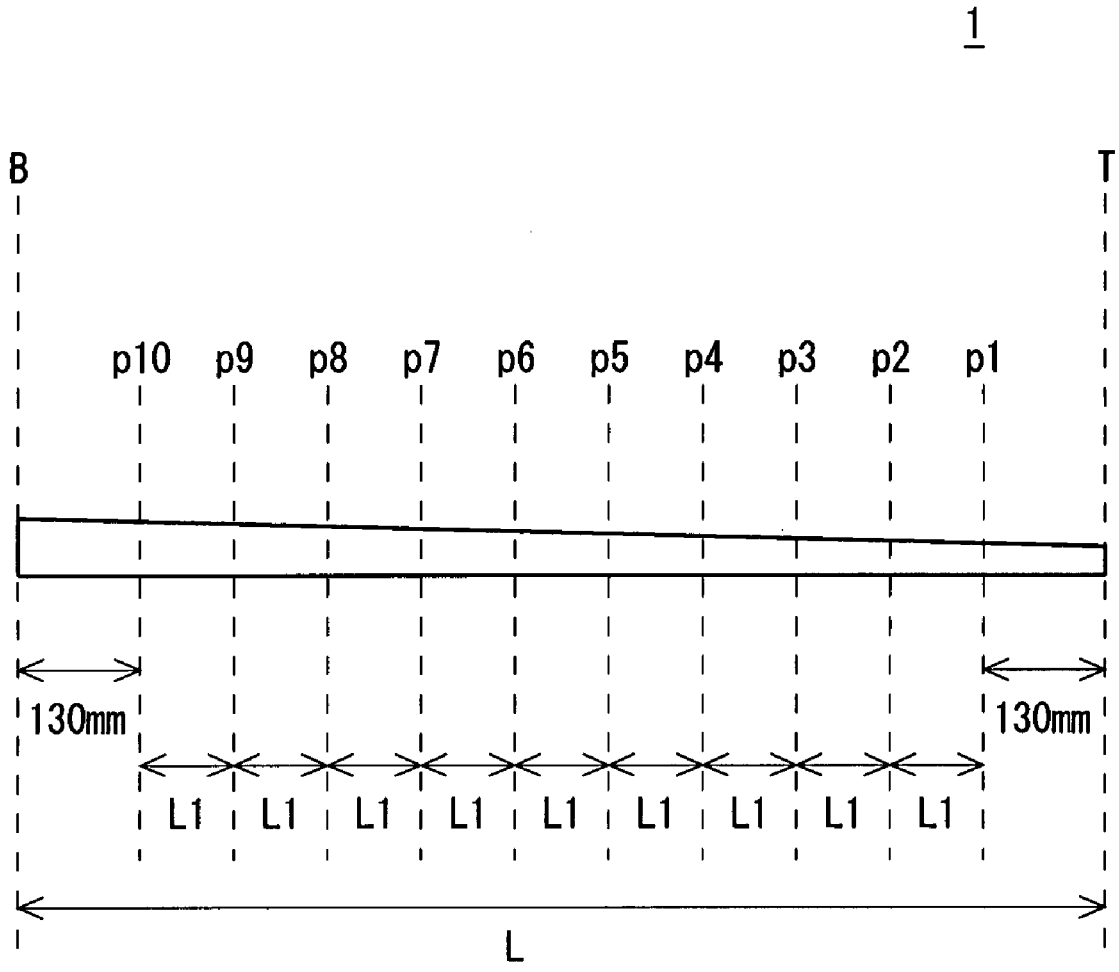
FIG. 1 shows a view for illustrating positions at which the flexural rigidity EI is measured in the shaft according to the present invention.

FIG. 1 shows an overall view illustrating shaft 1 for golf clubs according to one embodiment of the present invention. The shaft 1 for golf clubs has a tubular shape. The shaft 1 is substantially tapered in its entirety. The shaft 1 has a head-side end T, and a grip-side end B. The head-side end T is the edge on the side having a smaller diameter. The grip-side end B is the edge on the side having a greater diameter. Although not shown in the figure, a golf club head is attached in the vicinity of the head-side end T, while a grip is attached in the vicinity of the grip-side end B. The shaft 1 is a carbon shaft. The carbon shaft is manufactured with CFRP (carbon fiber reinforced resin).

In the present invention, flexural rigidity EI at positions of ten sites is defined. The position in the present invention referred to herein means a position along the shaft axis direction.

As the measurement position of the flexural rigidity EI, the positions of ten sites of from the first position to the tenth position are defined. As shown in FIG. 1, the position 130 mm away from the head-side end T of the shaft 1 is the first position p1. The position 130 mm away from the grip-side end B of the shaft 1 is the tenth position p10. Positions provided by equally dividing the length between the first position p1 and the tenth position p10 into nine regions are defined as the second position p2, the third position p3, the fourth position p4, the fifth position p5, the sixth position p6, the seventh position p7, the eighth position p8 and the ninth position p9 in this order from the head-side end T.

The positions of from the first position p1 to the tenth position p10 are arranged at even intervals along the shaft axis direction. What is indicated by L1 in FIG. 1 is the interval between adjacent positions. Provided that the shaft overall length is defined as L (mm), the interval L1 (mm) of the adjacent positions is represented by the following formula.

$$L1=(L-260)9$$

Each flexural rigidity EI measured at ten sites of from the first position p1 to the tenth position p10 is each defined as EI (1), EI (2), EI (3), EI (4), EI (5), EI (6), EI (7), EI (8), EI (9) and EI (10) in this order from the end T side. More specifically, they may be explained as described below.

1) The flexural rigidity EI measured at the first position p1 is EI (1).

2) The flexural rigidity EI measured at the second position p2 is EI (2).

3) The flexural rigidity EI measured at the third position p3 is EI (3).

4) The flexural rigidity EI measured at the fourth position p4 is EI (4).

5) The flexural rigidity EI measured at the fifth position p5 is EI (5).

6) The flexural rigidity EI measured at the sixth position p6 is EI (6).

7) The flexural rigidity EI measured at the seventh position p7 is EI (7).

8) The flexural rigidity EI measured at the eighth position p8 is EI (8).

9) The flexural rigidity EI measured at the ninth position p9 is EI (9).

10) The flexural rigidity EI measured at the tenth position p10 is EI (10).

Figure 2A:
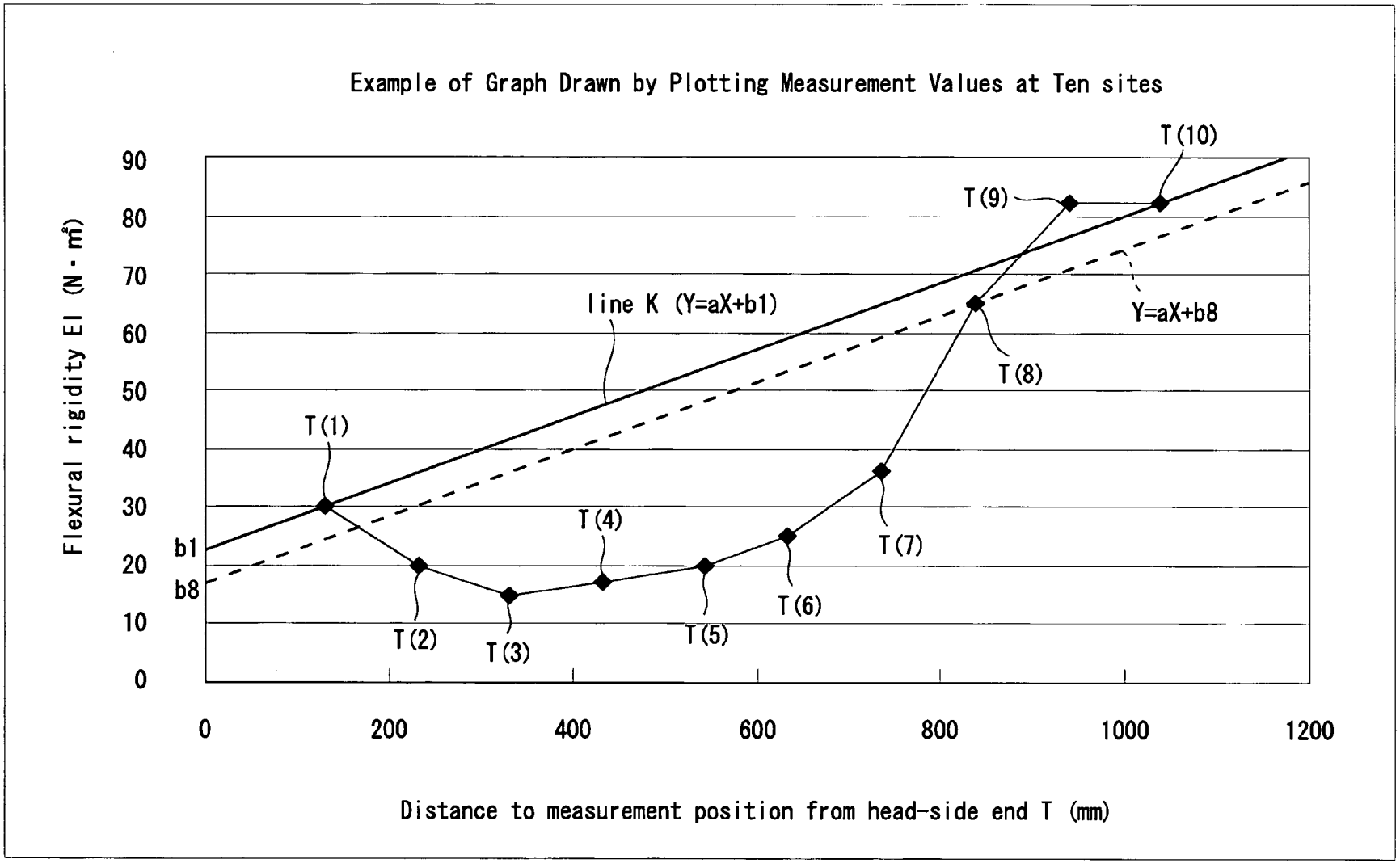
FIG. 2A shows one example of the graph drawn by plotting measurement values of flexural rigidity EI at ten sites on the X-Y coordinate plane.
Figure 2B:
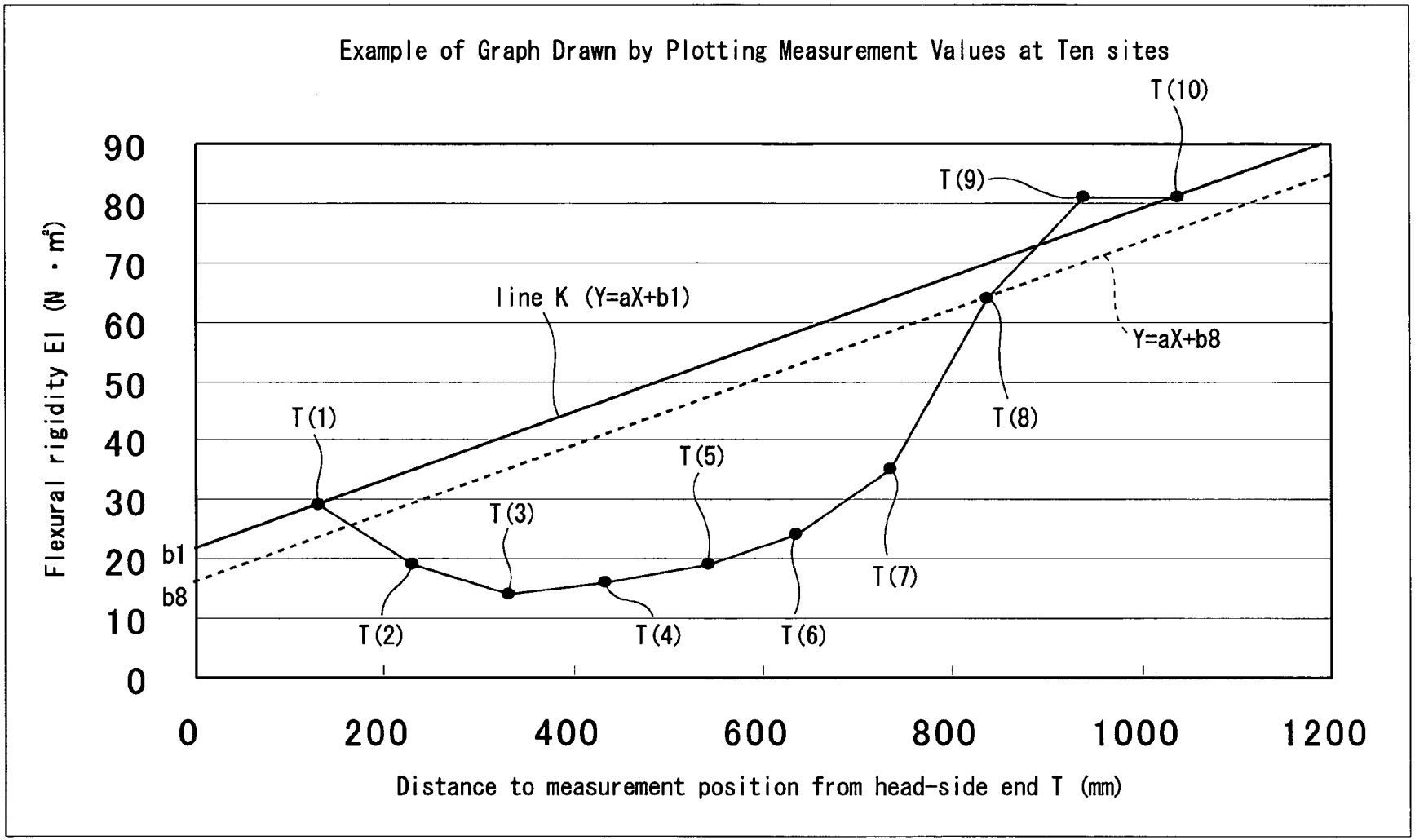
FIG. 2B shows one example of the graph drawn by plotting measurement values of flexural rigidity EI at ten sites on the X-Y coordinate plane.

On the basis of these measurement values, a graph is produced on an X-Y coordinate plane. One examples of this graph is shown in FIG. 2A and FIG. 2B. In this X-Y coordinate plane, the X-axis represents the distance (mm) to the measurement position from the head-side end T. The Y-axis represents the value of flexural rigidity EI (N·m$^2$). Each point obtained by plotting the measurement values at the positions of ten sites on this X-Y coordinate plane is defined as T (1), T (2), T (3), T (4), T (5), T (6), T (7), T (8), T (9) and T (10) in this order from the head end T side. More specifically, they may be explained as described below.

1) The X-coordinate of T (1) is 130, and the Y-coordinate of T (1) is EI (1).

2) The X-coordinate of T (2) is (L1×1+130), and the Y-coordinate of T (2) is EI (2).

3) The X-coordinate of T (3) is (L1×2+130), and the Y-coordinate of T (3) is EI (3).

4) The X-coordinate of T (4) is (L1×3+130), and the Y-coordinate of T (4) is EI (4).

5) The X-coordinate of T (5) is (L1×4+130), and the Y-coordinate of T (5) is EI (5).

6) The X-coordinate of T (6) is (L1×5+130), and the Y-coordinate of T (6) is EI (6).

7) The X-coordinate of T (7) is (L1×6+130), and the Y-coordinate of T (7) is EI (7).

8) The X-coordinate of T (8) is (L1×7+130), and the Y-coordinate of T (8) is EI (8).

9) The X-coordinate of T (9) is (L1×8+130), and the Y-coordinate of T (9) is EI (9).

10) The X-coordinate of T (10) is (L1×9+130), and the Y-coordinate of T (10) is EI (10).

On the aforementioned X-Y coordinate plane, the formula representing the line K that passes the T (1) and the T (10) on the X-Y coordinate plane is defined as [Y=aX+b1] In other words, the slope of the line K is represented by "a", and the Y-intercept ($N \cdot m^2$) of the line K is defined as b1.

The values at the Y-intercepts on the lines that are parallel to the aforementioned line K and that pass the aforementioned points of T (2), T (3), T (4), T (5), T (6), T (7), T (8) and T (9), respectively, are defined as b2, b3, b4, b5, b6, b7, b8 and b9, respectively. More specifically, they may be explained as described below.

1) T2 is a point on the line represented by the formula:

$$[Y=aX+b2].$$

2) T3 is a point on the line represented by the formula:

$$[Y=aX+b3].$$

3) T4 is a point on the line represented by the formula:

$$[Y=aX+b4].$$

4) T5 is a point on the line represented by the formula:

$$[Y=aX+b5].$$

5) T6 is a point on the line represented by the formula:

$$[Y=aX+b6].$$

6) T7 is a point on the line represented by the formula:

$$[Y=aX+b7].$$

7) T8 is a point on the line represented by the formula:

$$[Y=aX+b8].$$

8) T9 is a point on the line represented by the formula:

$$[Y=aX+b9].$$

FIG. 2A shows one example of a graph drawn by plotting the measurement values at ten sites. Solid line in FIG. 2A shows the line K described above. The broken line in FIG. 2A shows a line represented by the formula [Y=aX+b8] that passes T8, as one example of the lines that pass T2 to T9, respectively. FIG. 2A shows a graph demonstrating Example 1 described later.

FIG. 2B shows one example of a graph drawn by plotting the measurement values at ten sites. Solid line in FIG. 2B shows the line K described above. The broken line in FIG. 2B shows a line represented by the formula [Y=aX+b8] that passes T8, as one example of the lines that pass T2 to T9, respectively. FIG. 2B shows a graph demonstrating Example 3 described later.

The minimum value among the Y-intercept values b2 to b9 is defined as bmin. More specifically, the minimum value among b2, b3, b4, b5, b6, b7, b8 and b9 is the bmin.

In the shaft 1 defined as in the foregoing, the slope "a" of the line K is preferably equal to or greater than 0.04, and more preferably equal to or greater than 0.05. The slope "a" of the line K is preferably equal to or less than 0.06. Every one of the b3, b4, b5, b6, b7 and b8 described above is preferably smaller than b1. It is preferred that the aforementioned bmin be any one of b4, b5, b6 or b7. It is preferred that the value (b1−bmin) is 30 ($N \cdot m^2$) or greater and 40 ($N \cdot m^2$) or less. In addition, it is preferred that the value (b9-b1) is 4 ($N \cdot m^2$) or greater and 15 ($N \cdot m^2$) or less.

Next, operational advantages of such shaft, and the shaft behavior to be the premise thereof will be explained.

In the golf club, a head is attached at the head-side end T of the shaft. This head has a comparably great weight. Resulting from inertia of this head and the like, the shaft behavior during swing will be as described below.

When the swing is initiated, i.e., in the beginning of raising (taking back), the shaft is bent in the direction to give the head side getting behind. Due to the counteraction thereof, the shaft is bent so that the head side precedes in the raised direction after completing the raising. Such bending is further increased in the beginning of the downward swing. More specifically, in the beginning of the downward swing, the shaft is bent in the direction to give the head side getting behind with respect to the direction of the downward swing. Due to the counteraction of such bending, the shaft tends to be bent so that the head side precedes in the swinging direction during the time period of from initiation of the downward swing to the impact. This behavior of the shaft affects the head speed upon impact. By recovery of the bending of the shaft from the state in which the head side is getting behind to the state in which the head side is not getting behind, the head speed upon impact can be accelerated.

Accordingly, the head speed S1 upon impact shall be total speed of the swing speed S1 of the entire shaft, and the head speed S2 resulting from the bending. In other words, they follow a relationship represented by the formula [Si=S1+S2]. The swing speed S1 is defined as the head speed resulting from the movement of the entire shaft.

The head speed S2 may vary depending on the state of the shaft upon impact. The head speed S2 may vary depending on the bending behavior of the shaft, and timing of the impact. When the shaft behavior and the timing of the impact are unsatisfactory, the head speed S2 may present a minus value. Recovery of the bending can lead to either acceleration of the head, or deceleration thereof. When the impact is executed in the state in which the shaft is bent to give the head side getting behind, acceleration resulting from the bending cannot be sufficiently achieved, whereby the head speed S2 is lowered. In the case in which the impact is executed at the moment when the bending in the direction to give the head side getting behind recovers, the head speed S2 can reach to the maximum. In other words, the head speed S2 can be maximized by substantial coincidence of the moment at which the bending in the direction to give the head side getting behind recovers to the state of the shaft being almost straight, and the moment of the impact. By maximizing the head speed S2, the head speed Si upon impact can be maximized.

In order to increase the head speed S2 resulting from the bending of the shaft, it is necessary to increase the bending of the shaft during swing. In order to increase the bending of the shaft during swing, it is desired that flexural rigidity EI of the shaft in its intermediate part is decreased. However, when the flexural rigidity EI of the shaft in its intermediate part is merely decreased, the impact tends to be executed while keeping the state in which the head side of the shaft is getting behind. This tendency is noticeably found in beginners among the golf players, in particular. In order to correct this tendency, increase in the flexural rigidity EI on the grip side of the shaft is effective. More specifically, by decreasing flexural rigidity EI in the intermediate part and increasing flexural rigidity EI on the grip side, the bending in the direction to give the head getting behind is increased, and the impact can be executed at the moment when this bending is almost abolished.

The bending of the shaft at the impact may affect the directionality of the hit ball because the orientation of the face at impact can vary depending on the bending of the shaft upon impact. For example, the bending in the direction to give the head side getting behind makes it easy to cause an open face. Due to the open face, a slice of the hit ball is liable to be caused. To the contrary, the bending in the direction to give the head side being preceded makes it easy to cause a closed face. Due to the closed face, a hook of the hit ball is liable to be caused. Impact in the state in which the bending of the shaft is almost abolished can improve the directionality of the hit ball.

The bending of the shaft upon impact may also affect the launch angle. The bending in the direction to give the head side getting behind can reduce the loft angle at impact. When the loft angle at impact is small, the launch angle may be reduced, thereby achieving lower trajectory. The impact in the state in which the bending of the shaft is almost abolished can increase the loft angle at impact as compared with the impact in the state of the head side getting behind. The increase in the loft angle at impact may increase the launch angle. Increase in the launch angle can be responsible for increase in the flight distance.

In light of increase in the head speed S2 through increasing the bending of the shaft in the beginning of the downward swing, it is preferred that every one of the b3, b4, b5, b6, b7 and b8 is smaller than b1. In light of increase in the head speed S2 through increasing the bending of the shaft in the beginning of the downward swing, it is preferred that the bmin is any one of b4, b5, b6 or b7, and is more preferred that bmin is b5 or b6.

In light of improvement of the feel at impact and timing of hitting the ball while making the middle part of the shaft soft, it is necessary to make the shaft rear end harder than the shaft tip part. In light of improvement of the feel at impact and timing of hitting the ball, the slope "a" of the line K is preferably equal to or greater than 0.04, and more preferably equal to or greater than 0.05. In light of preventing the feel at impact from becoming too hard, the slope "a" of the like K is preferably equal to or less than 0.06.

In particular, the shaft weight is preferably 30 g or greater and 50 g or less for less powerful golf players. When the shaft is too light, decision of timing of the swing may be difficult, whereby hitting at the sweet spot may be difficult. In this respect, the shaft weight is preferably equal to or greater than 30 g, and more preferably equal to or greater than 32 g. In light of ease in acceleration of the head speed even in the hitting by less powerful golf players, the shaft weight is preferably equal to or less than 50 g.

In use by the less powerful golf players, in light of increase in the head speed S2 through increasing the bendability of the shaft in the beginning of the downward swing, the value (b1−bmin) is preferably equal to or greater than 30 ($N \cdot m^2$), more preferably equal to or greater than 31 ($N \cdot m^2$), and particularly preferably 32 ($N \cdot m^2$). In use by less powerful golf players, in light of preventing the impact from being executed before perfect recovery from the bending of the shaft, the value (b1−bmin) is preferably equal to or less than 40 ($N \cdot m^2$), more preferably equal to or less than 39 ($N \cdot m^2$), and particularly preferably equal to or less than 38 ($N \cdot m^2$).

The value (b9−b1) correlates with likelihood of recovery from the bent shaft. Particularly for less powerful golf players, it is efficacious to accelerate the head speed by a shaft the bending of which can be readily recovered. As the value (b9−b1) is greater, the bending tends to be readily recovered. In light of ease in recovery from the bending for the less powerful golf players, the value (b9−b1) is preferably equal to or greater than 4 ($N \cdot m^2$), more preferably equal to or greater than 5 ($N \cdot m^2$), and particularly preferably equal to or greater than 6 ($N \cdot m^2$). When the bending recovers excessively, the impact in the state in which the head precedes is liable to be executed. In light of inhibition of the impact in the state in which the head precedes, and suppression of a hook of the ball for less powerful golf players, the value (b9−b1) is preferably equal to or less than 15 ($N \cdot m^2$), more preferably equal to or less than 14 ($N \cdot m^2$), and particularly preferably equal to or less than 13 ($N \cdot m^2$).

The shaft of the present invention (first invention) has a straight layer. The straight layer means a layer which is constituted with a fiber reinforced resin, and the orientation angle of the fiber of which is substantially parallel to the shaft axis line. However, in general, the orientation angle of the fiber can not be completely parallel to the shaft axis line. Resulting from errors which may be caused in wrapping pre-pregs on the tapered face, it is difficult to make all carbon fibers completely parallel to the shaft axis line. The angle formed with the orientation direction of the fiber constituting the straight layer and the shaft axis line is usually within ±10 degrees.

The fiber constituting the straight layer is preferably a carbon fiber. In light of enhancing the strength against the bending of the shaft, tensile strength of the fiber constituting the straight layer is preferably equal to or greater than 580 $kgf/mm^2$, more preferably equal to or greater than 590 $kgf/mm^2$, and particularly preferably equal to or greater than 600 $kgf/mm^2$. Taking into consideration of the physical properties of available carbon fibers, the tensile strength of the fiber constituting the straight layer is preferably equal to or less than 680 $kgf/mm^2$. The following Table 1 shows item numbers of pre-pregs manufactured by Toray Industries, Inc., item numbers of carbon fibers used in the pre-pregs, tensile modulus of elasticity of the carbon fibers, tensile strength of the carbon fibers, and density of the carbon fibers. As shown in Table 1, illustrative examples of the pre-pregs in which the carbon fiber having a tensile strength of equal to or greater than 580 $kgf/mm^2$ include 2255G-10, 2255G-12 and 2255G-15. In these pre-pregs, carbon fiber having an item number T800G is used. Hereinafter, the straight layer the tensile strength of the carbon fiber of which is equal to or greater than 580 $kgf/mm^2$ is also referred to as a high-strength straight layer.

The shaft of the present invention (first invention) has a hoop layer. The hoop layer means a layer which is constituted with a fiber reinforced resin, and the orientation angle of the fiber of which is substantially orthogonal to the shaft axis line. However, due to errors which may be caused in wrapping the pre-pregs, there may be the cases in which the orientation angle of the fiber can not be completely orthogonal to the shaft axis line. The angle formed with the orientation direction of the fiber constituting the hoop layer and the shaft axis line is usually 85 degrees or greater and 95 degrees or less.

As the hoop layer, for example, 805S-3 and the like manufactured by Toray Industries, Inc., listed in Table 1 below may be used. This 805S-3 has less weight per unit area, less weight of the carbon fiber per unit area, and smaller thickness as compared with other pre-preg types. Such a thin pre-preg is suited for the hoop layer since the carbon fiber can be easily bent and wrapped.

TABLE 1

| Values of physical properties of carbon fiber of pre-preg | | | Values of physical properties of carbon fiber | | | |
|---|---|---|---|---|---|---|
| Manufacturer | Kind | Pre-preg item number | carbon fiber item number | tensile modulus of elasticity ($t/mm^2$) | tensile strength ($kgf/mm^2$) | density ($g/cm^3$) |
| Toray Industries, Inc., | 24t | 3255S-10, -12, -15 | T700S | 23.5 | 500 | 1.80 |
| | | 3255G-10, -12, -15 | T700G | 24.5 | 500 | 1.80 |
| | 30t | 8255S-10, -12, -15 | M30S | 30 | 560 | 1.73 |
| | | 805S-3 | M30S | 30 | 560 | 1.73 |
| | | 2255F-10, -12, -15 | T800H | 30 | 560 | 1.81 |
| | | 2255G-10, -12, -15 | T800G | 30 | 630 | 1.81 |
| | 40t | 9255S-7 | M40S | 38.5 | 460 | 1.80 |
| Mitsubishi Rayon Co., Ltd. | 24t | TR1100M, TR1120M | TR40 | 24 | 400 | 1.80 |
| | cloth | TR3110M | TR30S | 24 | 300 | 1.80 |

-3, -10, -12, and -15 represent the weight of the carbon fiber per $m^2$ of the pre-preg.
Tensile strength, tensile modulus of elasticity are values measured in accordance with JIS R7601: 1986 "Testing methods for carbon fibers".

When the high-strength straight layer is provided in part along the shaft longitudinal direction, stress generated upon bending of the shaft is likely to be converged at the end of the high-strength straight layer (break site). This converge of the stress can diminish the strength of the shaft. Therefore, the high-strength straight layer is provided along the overall length of the shaft. Preferably, whole of the high-strength straight layer is provided along the overall length of the shaft. At least one high-strength straight layer may be provided. It is preferred that the high-strength straight layer is wrapped around at least once (1 ply) or more along the overall length of the shaft.

The hoop layer is provided along 50% or more of the shaft overall length. For example, when the shaft overall length is 1169 mm, the length in the shaft longitudinal direction of the hoop layer is set to be 584.5 mm.

In bending, a force in a direction to permit collapse acts on the shaft. Due to this force, the shaft is deformed. This deformation is also referred to as "collapsing deformation" below. The collapsing deformation makes the cross section of the shaft approximately elliptical. As the collapsing deformation becomes significant, collapse of the shaft can be caused. By providing the hoop layer, the shaft becomes resistant to the collapse, thereby capable of enhancing the strength of the shaft.

As described above, in the present invention, for the purpose of accommodating the less powerful golf player, the value (b1−bmin) is set to be greater than that in Japanese Patent Application No. 2006-177457. By setting the value (b1−bmin) to be greater, the strength can be insufficient. According to the present invention (first invention), insufficiency of the strength can be prevented by providing the hoop layer along 50% or more of the shaft overall length.

Influence of the hoop layer upon rigidity in the bent direction of the shaft is small. The influence of the hoop layer upon rigidity in the bent direction is smaller as compared with that of the straight layer. To the contrary, influence of the hoop layer upon the collapsing deformation is great.

Upon hitting, a particularly great impulse force acts on the vicinity of the head. For the purpose of reinforcing the head vicinity, general shafts are provided with a tip reinforcing layer for reinforcing only the vicinity of the tip part. Because of the presence of this tip reinforcing layer, the thickness of the shaft is generally larger at the tip side than the posterior end side. Also, the shaft is usually tapered. At the part close to the head-side end T, the shaft has comparatively small diameter. At the part close to the grip-side end B, the shaft has comparatively large diameter.

Portion having a smaller thickness is more likely to be collapsed. In addition, portion having a larger shaft diameter is likely to be collapsed. Because the hoop layer effectively suppresses the collapse of the shaft, it is efficacious to be used at a portion that is more likely to be collapsed. Portion having a larger thickness is resistant to collapse. Also, portion having a smaller shaft diameter is resistant to collapse. Comparatively less effect of providing the hoop layer would be exerted to such portions which are resistant to collapse. Therefore, less sense is expected for providing the hoop layer along the shaft overall length. In these respects, it is preferred that the hoop layer be provided at a part closer to the grip-side end B. Provided that the distance in the shaft longitudinal direction from the grip-side end B is defined as Lb, the hoop layer is preferably disposed in the range of Lb from 0 mm to Pf mm. It is preferred that the head-side position Pf of the hoop layer measured from the grip-side end B be 50% or more of the shaft overall length L. In other words, the position Pf is preferably situated at equal to or greater than L/2. The position Pf may also be situated at equal to or greater than 60% of the shaft overall length L. The position Pf may be situated at 100% of the shaft overall length L. In light of weight saving of the shaft, the position Pf is preferably equal to or less than 80%, and more preferably 75% of the shaft overall length L.

According to Japanese Patent Application No. 2006-177457, the bending of the shaft, and the recovery from the bending are optimized, thereby capable of accelerating the head speed. However, if the head speed can be accelerated for less powerful golf players who attain much slower head speed, it would be extremely preferred for the less powerful golf player. As described above, in order to accelerate the head speed for the less powerful golf players, the greater value (b1−bmin) would be desired. However, by merely increasing the value (b1−bmin), the strength of the shaft is likely to be decreased. Hence, according to the present invention (first invention), the high-strength straight layer and the hoop layer are employed.

The high-strength straight layer can enhance the shaft strength against the force in the flexure direction. In addition, the hoop layer can enhance the shaft strength. As described above, the hoop layer can enhance the shaft strength because collapse of the shaft resulting from the shaft flexure is suppressed.

The hoop layer can accelerate the recovery from the bending without impairment of the extent of the bendability. Relationship between the bending and recovery from the bending, and the hoop layer will be further explained. Since orientation angle of the fiber of the hoop layer is substantially orthogonal to the shaft longitudinal direction, less influence is imparted upon the shaft flexural rigidity. Therefore, the hoop layer hardly impairs the bendability of the shaft in use by less powerful golf players. To the contrary, as described above, when the shaft is bent, collapsing deformation is caused. In other words, the shaft flexure deformation is in conjunction with collapsing deformation. The hoop layer enhances the reactive force against the collapsing deformation. The hoop layer is responsible for early recovery from the collapsing deformation. Due to the early recovery from the collapsing deformation, the shaft bending also recovers at an early stage. Accordingly, the hoop layer accelerates recovery of the shaft. As described above, according to the shaft of the present invention (first invention), bendability is not impaired, and early recover from the bending is enabled. Therefore, the shaft of the present invention (first invention) is particularly suited for less powerful golf players.

The shaft of the present invention (second invention) has a textile layer. The textile layer includes a textile. This textile is constituted with a carbon fiber. This textile is manufactured by weaving a carbon fiber bundle.

The textile layer may be provided by wrapping a pre-preg. The pre-preg is produced by impregnating a resin in a fiber textile. Also, the textile layer may be provided by wrapping the textile alone. The textile layer may be provided either by hardening the pre-preg, or with the textile without including the resin impregnated therein. The textile layer of Examples described later is produced by wrapping the pre-preg.

The textile included in the textile layer is produced by weaving the warp and the weft. The warp is substantially orthogonal to the weft. The warp and weft is derived from a carbon fiber bundle. As the warp and weft, for example, carbon fiber bundles of 1K, 3K, 6K, 12K, 24K, 48K and the like may be used. For example, 12K means that number of included filaments is 12000. Generally used are 12K carbon fiber bundles.

Weave of the textile may be plain weave, twill weave, satin weave and the like. Steps for manufacturing the shaft include a wrapping step of the textile. The plain-woven textile has high density of the weaving, therefore, the fiber bundle is hardly movable in the wrapping step. The plain-woven textile can suppress the variance of physical properties of the shaft. In this respect, the most preferable weave is the plain weave.

Either one of the warp or weft (for example, warp) is oriented substantially to the shaft axis direction. Resulting from the errors and the like which may be caused in wrapping on the tapered face, it is difficult to make the fiber completely parallel to the shaft axis line. The angle formed with the orientation direction of either one of the warp or weft (for example, warp) and the shaft axis line is generally within ±10 degrees.

Another one of the warp and weft (for example, weft) is oriented substantially to the orthogonal direction with respect to the shaft axis direction. Resulting from the errors and the like which may be caused in manufacture of the shaft, there may be the case in which the orientation angle of the fiber is not completely orthogonal with respect to the shaft axis line. The angle formed with the orientation direction of another one of the warp and weft (for example, weft) and the shaft axis line is generally 85 degrees or greater and 95 degrees or less.

As the fiber constituting the textile layer, carbon fibers are preferred. Tensile strength of the carbon fiber constituting the textile layer is not particularly limited. In light of enhancement of the strength against the bending of the shaft, the tensile strength of the fiber constituting the textile layer is preferably equal to or greater than 300 kgf/mm$^2$, more preferably equal to or greater than 350 kgf/mm$^2$, and particularly preferably equal to or greater than 400 kgf/mm$^2$. Taking into consideration of the physical properties of currently available carbon fibers, the tensile strength of the fiber constituting the textile layer is preferably equal to or less than 680 kgf/mm$^2$.

Table 1 presented above shows item numbers of the pre-pregs, item numbers of the carbon fibers used in the pre-pregs, tensile modulus of elasticity of the carbon fiber, tensile strength of the carbon fiber, and density of the carbon fiber. The pre-pregs shown in Table 1 are manufactured by Toray Industries, Inc., or manufactured by Mitsubishi Rayon Co., Ltd. As listed in Table 1, TR1100M, TR1120M and TR3110M manufactured by Mitsubishi Rayon Co., Ltd. can be used as the textile layer. TR1100M, TR1120M and TR3110M manufactured by Mitsubishi Rayon Co., Ltd. are pre-pregs produced by impregnating a resin in a plain-woven textile.

It is preferred that the shaft of the present invention (second invention) has a straight layer. The straight layer improves the flexural rigidity of the shaft. The straight layer facilitates designing of the forward flex and the backward flex. The straight layer improves the flexural strength of the shaft. The straight layer is a layer comprising a fiber reinforced resin, and the orientation angle of the fiber of which is substantially parallel to the shaft axis line. However, in general, the orientation angle of the fiber can not be completely parallel to the shaft axis line. Resulting from the errors which may be caused in wrapping the pre-preg on the tapered face, it is difficult to make all the fibers completely parallel to the shaft axis line. The angle formed with the orientation direction of the fiber constituting the straight layer and the shaft axis line is generally within ±10 degrees.

As the fiber constituting the straight layer, carbon fibers are preferred. In light of enhancement of the strength (flexural strength) against the bending of the shaft, the tensile strength of the fiber constituting the straight layer is preferably equal to or greater than 500 kgf/mm$^2$ in the second invention. In light of enhancement of the flexural strength of the shaft, it is preferred that at least one high-strength straight layer having a tensile strength of equal to or greater than 580 kgf/mm$^2$ is disposed. It is preferred that the high-strength straight layer is provided along the overall length of the shaft. The tensile strength of the fiber constituting the high-strength straight layer is more preferably equal to or greater than 590 kgf/mm$^2$, still more preferably equal to or greater than 600 kgf/mm$^2$, and particularly preferably equal to or greater than 630 kgf/mm$^2$. Taking into consideration of the physical properties of available carbon fibers, the tensile strength of the fiber constituting the high-strength straight layer is preferably equal to or less than 680 kgf/mm$^2$.

The shaft of the present invention (second invention) may have a hoop layer. The hoop layer means a layer which is constituted with a fiber reinforced resin, and the orientation angle of the fiber of which is substantially orthogonal with respect to the shaft axis line. As the hoop layer, for example, 805S-3 and the like manufactured by Toray Industries, Inc., listed in the above Table 1 is used. This 805S-3 has lower weight per unit area, lower weight of the carbon fiber per unit area, and a smaller thickness as compared with other pre-preg types. Such a thin pre-preg is suited for the hoop layer because the carbon fiber can be readily bent and wrapped.

In bending, a force in a direction to permit collapse acts on the shaft. Due to this force, the shaft is deformed. This deformation is also referred to as "collapsing deformation" below. The collapsing deformation makes the cross section of the shaft approximately elliptical. As the collapsing deformation becomes significant, collapse of the shaft can be caused. The textile layer includes fibers oriented substantially orthogonal to the shaft axis direction. The fibers are wrapped substantially along circumferential direction of the shaft. The fiber is also referred to as "fiber in the circumferential direction" below. Due to the fiber in the circumferential direction of the textile layer, the shaft becomes resistant to the collapse, thereby capable of enhancing the strength of the shaft.

The textile layer has fibers that are substantially parallel to the shaft axis direction. This fiber is also referred to as "fiber in the axis direction" below. Due to the fiber in the axis direction, the strength against the flexure deformation is enhanced.

As described above, in the present invention, for the purpose of accommodating the less powerful golf player, the value (b1−bmin) is set to be greater than that in Japanese Patent Application No. 2006-177457. By setting the value (b1−bmin) to be great, the strength can be insufficient. According to the present invention (second invention), insufficiency of the strength can be prevented by providing the textile layer.

Influence of the fiber in the circumferential direction upon rigidity in the bent direction of the shaft is small. The influence of the fiber in the circumferential direction upon rigidity in the bent direction is smaller as compared with that of the fiber in the axis direction. To the contrary, influence of the fiber in the circumferential direction upon the collapsing deformation is great.

Upon hitting, a particularly great impulse force acts on the vicinity of the head. For the purpose of reinforcing the head vicinity, general shafts are provided with a tip reinforcing layer for reinforcing only the vicinity of the tip part. Because of the presence of this tip reinforcing layer, the thickness of the shaft is generally larger at the tip side than the posterior end side. Also, the shaft is usually tapered. At the part close to the head-side end T, the shaft has comparatively small diameter. At the part close to the grip-side end B, the shaft has comparatively large diameter.

Portion having a smaller thickness is more likely to be collapsed. In addition, portion having a larger shaft diameter is likely to be collapsed. The fiber in the circumferential direction effectively suppresses the collapse of the shaft. It is efficacious to use the fiber in the circumferential direction at a portion that is more likely to be collapsed. In this respect, it is preferred that the textile layer be provided on at least a rear end part of the shaft. Specifically, provided that the distance in the shaft longitudinal direction from the grip-side end B is defined as Lb, and the textile layer is disposed in the range of Lb from 0 mm to Pf mm, it is preferred that the position Pf be situated at 50% or more of the shaft overall length L. In other words, the position Pf is preferably situated at equal to or greater than L/2. More preferably, the position Pf is situated at equal to or greater than ⅔ of the shaft overall length L. In light of improvement of the effect by the textile layer, it is particularly preferred that the textile layer be provided along the overall length of the shaft.

According to Japanese Patent Application No. 2006-177457, the bending of the shaft and the recovery from the bending are optimized, thereby capable of accelerating the head speed. However, if the head speed can be accelerated for less powerful golf players who attain much slower head speed, it would be extremely preferred for the less powerful golf player. As described above, in order to accelerate the head speed for the less powerful golf players, the greater value (b1−bmin) would be desired. However, by merely increasing the value (b1−bmin), the strength of the shaft is likely to be decreased. Hence, according to the present invention (second invention), the textile layer is employed.

The fiber in the axis direction of the textile layer can enhance the shaft strength against the force in the flexure direction. In addition, the fiber in the circumferential direction of the textile layer can enhance the shaft strength. As described above, the fiber in the circumferential direction can enhance the shaft strength because collapse of the shaft resulting from the shaft flexure is suppressed.

The fiber in the circumferential direction can accelerate the recovery from the bending without impairment of the extent of the bendability. Relationship between the bending and recovery from the bending, and the fiber in the circumferential direction will be further explained. Since orientation angle of the fiber in the circumferential direction is substantially orthogonal to the shaft longitudinal direction, less influence is imparted upon the shaft flexural rigidity. Therefore, the fiber in the circumferential direction hardly impairs the bendability of the shaft in use by less powerful golf players. To the contrary, as described above, when the shaft is bent, collapsing deformation is caused. In other words, the shaft flexure deformation is in conjunction with collapsing deformation. The fiber in the circumferential direction enhances the reactive force against the collapsing deformation. The fiber in the circumferential direction is responsible for early recovery from the collapsing deformation. Due to the early recovery from the collapsing deformation, the shaft also recovers from the bending at an early stage. Accordingly, the fiber in the circumferential direction accelerates recovery of the shaft. As described above, according to the shaft of the present invention (second invention), bendability is not impaired, and early recover from the bending is enabled. Therefore, the shaft of the present invention (second invention) is particularly suited for less powerful golf players.

The textile layer is produced by weaving the fiber in the axis direction and the fiber in the circumferential direction each other. By thus weaving, the fiber in the circumferential direction is reinforced by the fiber in the axis direction. This reinforcement can promote the effect of recovery from the collapsing deformation of the fiber in the circumferential direction more than that by the hoop layer. As compared with the case in which the straight layer and the hoop layer are used in combination, the textile layer has a more significant effect to accelerate the recovery from the bending. Because plain-woven textiles have high density of the weaving, the aforementioned reinforcing effect of the fiber in the axis direction is particularly significant. Therefore, the plain-woven textile is highly effective in recovery from the collapsing deformation.

Figure 3:
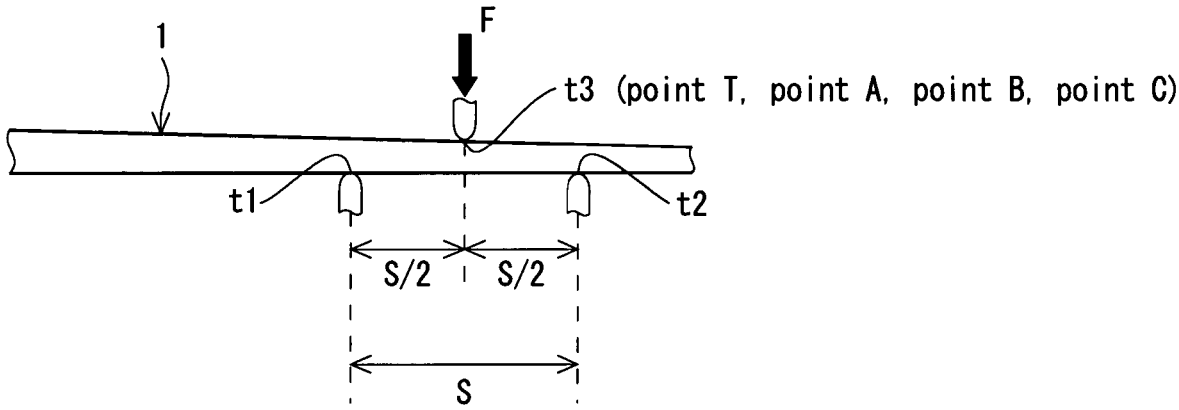
FIG. 3 shows an explanatory view for illustrating a process for measuring the SG three-point flexural strength.

The SG three-point flexural strength is a breaking strength of SG formula defined by Japan Consumer Product Safety Association. FIG. 3 shows a process for measuring the SG three-point flexural strength. As shown in FIG. 3, a load F is imparted downwardly from above at a weight point t3 while supporting shaft 1 at two supporting points t1, t2 from beneath. The position of the weight point t3 is a position decided by equally dividing the length of between the supporting point t1 and the supporting point t2. The measurement is performed after matching the weight point t3 with the point to be measured.

There are four measurement points of the SG three-point flexural strength, i.e., point T, point A, point B and point C. The point T is a point 90 mm away from the head-side end T. The point A is a point 175 mm away from the head-side end T. The point B is a point 525 mm away from the head-side end T. The point C is a point 175 mm away from the grip-side end B. Value of the load F when the shaft 1 was disrupted (peak value) corresponds to the SG three-point flexural strength. When the measurement is made at the point T, the span S is defined as 150 mm. When the measurement is made at the point A, the point B or the point C, the span S is defined as 300 mm.

In the present invention (first invention), the strength at the point B in the SG three-point flexural strength test (strength at point B) is defined. A variety of external force can act on the shaft in general use of golf clubs, in addition to the force that may act during swing. Examples of the external force which can act other than the force which acts during swing include the force that acts on the shaft when the club is removed from the caddie bag, the force that acts on the shaft when it is tread by accident, and the like. In light of suppression of disruption resulting from such external force, the strength at point B of SG three-point flexural strength is preferably equal to or greater than 60 kgf, more preferably equal to or greater than 62 kgf, and particularly preferably equal to or greater than 64 kgf. There is a correlation between the shaft strength and rigidity, and thus as the strength becomes greater, the EI value also tends to be greater. In light of prevention of the EI value from becoming excessively large, and of increase in bendability, the strength at point B is preferably equal to or less than 90 kgf.

Herein, the minimum value of from EI (1) to EI (10) is defined as E1, and the maximum value of from EI (1) to EI (7) is defined as E2. In light of making the middle part of the shaft soft to increase the head speed S2, E1 is preferably EI (2), EI (3), EI (4) or EI (5).

In light of suppression of excessive bending in the beginning of the downward swing, thereby preventing the impact from being executed before perfect recovery from the bending for the less powerful golf players, E1 is preferably equal to or greater than 12 ($N \cdot m^2$), more preferably equal to or greater than 13 ($N \cdot m^2$), and particularly preferably equal to or greater than 14 ($N \cdot m^2$). In light of increase in the head speed S2 through increasing the bendability of the shaft in the beginning of the downward swing, E1 is preferably equal to or less than 20 ($N \cdot m^2$), more preferably equal to or less than 19 ($N \cdot m^2$), and particularly preferably equal to or less than 18 ($N \cdot m^2$).

In light of optimization of the bending behavior of the shaft and the timing of the impact, accompanied by optimization of the extent of bendability of the shaft for the less powerful golf players, lower limit of the difference (E2−E1) is preferably equal to or greater than 15 ($N \cdot m^2$), more preferably equal to or greater than 18 ($N \cdot m^2$), while upper limit of the difference (E2−E1) is preferably equal to or less than 33 ($N \cdot m^2$), more preferably equal to or less than 30 ($N \cdot m^2$), and particularly preferably equal to or less than 29 ($N \cdot m^2$).

In light of making the recovery from the bending optimum, and inhibition of the impact in the state with the head getting behind, EI (10) is preferably equal to or greater than 60 ($N \cdot m^2$). In light of inhibition of the impact in the state in which the head precedes, and suppression of a hook of the ball, EI (10) is preferably equal to or less than 90 ($N \cdot m^2$).

The present invention is relevant to the bending of shafts, and recovery from the bending. As the shaft overall length L is greater, influence of the bending becomes greater. As the shaft overall length L is greater, the advantage of the present invention is likely to be more explicit. In this respect, the shaft overall length L is preferably equal to or greater than 41 inches (1041 mm), more preferably equal to or greater than 43 inches (1092 mm), still more preferably equal to or greater than 44 inches (1117 mm), and particularly preferably equal to or greater than 45 inches (1143 mm). In light of assurance of the strength of the shaft, the shaft overall length L is preferably equal to or less than 52 inches (1321 mm), more preferably equal to or less than 50 inches (1270 mm), and particularly preferably equal to or less than 48 inches (1219 mm).

For use by the less powerful golf players, in light of increase in the head speed S2 resulting from the bendability of the shaft while avoiding too hard feeling, the forward flex f of the shaft is preferably equal to or greater than 120 mm, more preferably equal to or greater than 121 mm, and particularly preferably equal to or greater than 122 mm. For use by the less powerful golf player, in light of avoiding too soft feeling, and inhibition of the impact in the state with the head getting behind, the forward flex f is preferably equal to or less than 160 mm, more preferably equal to or less than 159 mm, and particularly preferably equal to or less than 158 mm.

The method of manufacturing the shaft according to the present invention is preferably a sheet winding method. Examples of the matrix resin of CFRP (carbon fiber reinforced plastic) which can be used include epoxy resins, as well as thermosetting resins, thermoplastic resins and the like other than the epoxy resins.

EXAMPLES

Hereinafter, advantages of the present invention will be clarified by way of Examples, however, the present invention should not be construed as being limited based on the description of the Examples.

Measurement processes are as follows:

[Process for Measuring Flexural Rigidity EI]

Figure 4:
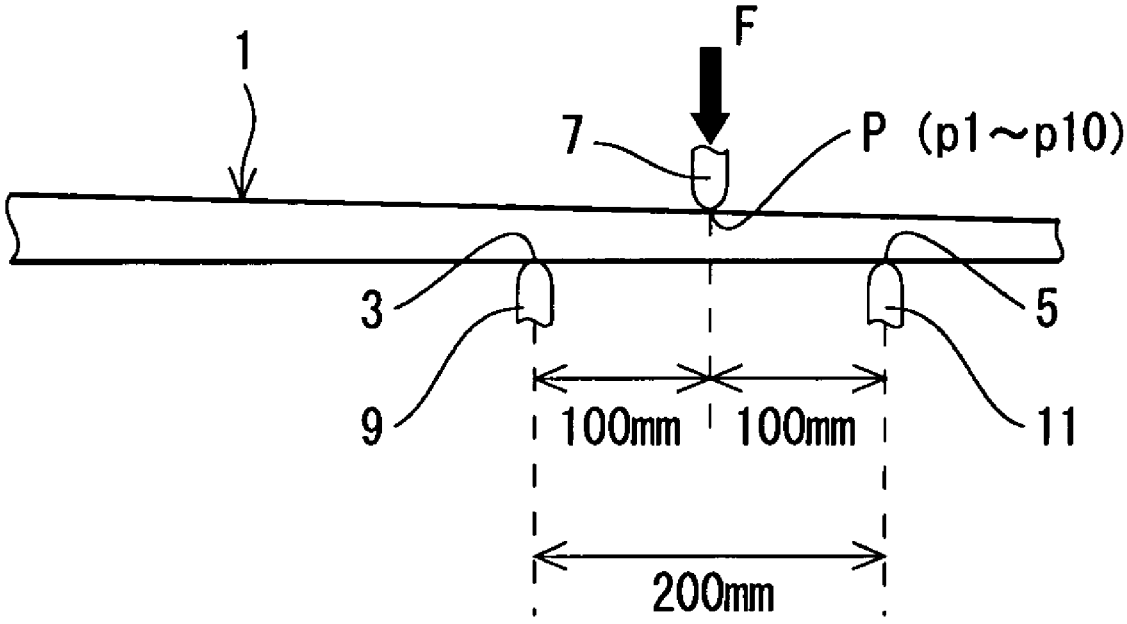
FIG. 4 shows an explanatory view for illustrating a process for measuring the flexural rigidity EI.

FIG. 4 shows an explanatory view for illustrating a process for measuring the flexural rigidity EI. The flexural rigidity EI was measured using type 2020 manufactured by INTESCO Co., Ltd. (maximum load: 500 kg). As shown in FIG. 4, deflection $\alpha$ was measured when a load F was applied to the measurement point P from above while supporting shaft 1 at two supporting points 3 and 5. The measurement point P may be any one of from p1 to p10 described above. Distance (span) between the supporting point 3 and the supporting point 5 was 200 mm. The measurement point P was located at a point provided by equally dividing the length between the supporting point 3 and the supporting point 5. Tip of the indentor 7 that applies the load F from above is rounded. Cross-sectional shape of the tip of the indentor 7 has a curvature radius of 10 mm in the cross section which is parallel to the shaft axis direction. In the cross section which is perpendicular to the shaft axis direction, the cross-sectional shape of the tip of the indentor 7 has a linear shape, and the length thereof is 45 mm.

By support 9, the shaft 1 is supported from beneath at the supporting point 3. The tip of the support 9 has a protruded round shape. Cross-sectional shape of the tip of the support 9 has a curvature radius of 15 mm in the cross section which is parallel to the shaft axis direction. In the cross section which is perpendicular to the shaft axis direction, the cross-sectional shape of the tip of the support 9 has a linear shape, and the length thereof is 50 mm. Support 11 has a shape that is the same as the support 9. By the support 11, the shaft 1 is supported from beneath at the supporting point 5. The tip of the support 11 has a protruded round shape. Cross-sectional shape of the tip of the support 11 has a curvature radius of 15 mm in the cross section which is parallel to the shaft axis direction. In the cross section which is perpendicular to the shaft axis direction, the cross-sectional shape of the tip of the support 11 has a linear shape, and the length thereof is 50 mm.

The indentor 7 was moved downward at a rate of 5 mm/min while fixing the support 9 and the support 11. When the load F reached to 20 kg, the movement of the indentor 7 was terminated. Deflection α (mm) of the shaft 1 at a moment when the movement of the indentor 7 was terminated was measured. The flexural rigidity EI ($N \cdot m^2$) was calculated according to the following formula.

$$EI(N \cdot m^2)=32.7/\alpha$$

[Measurement of Forward Flex f]

Figure 5A:
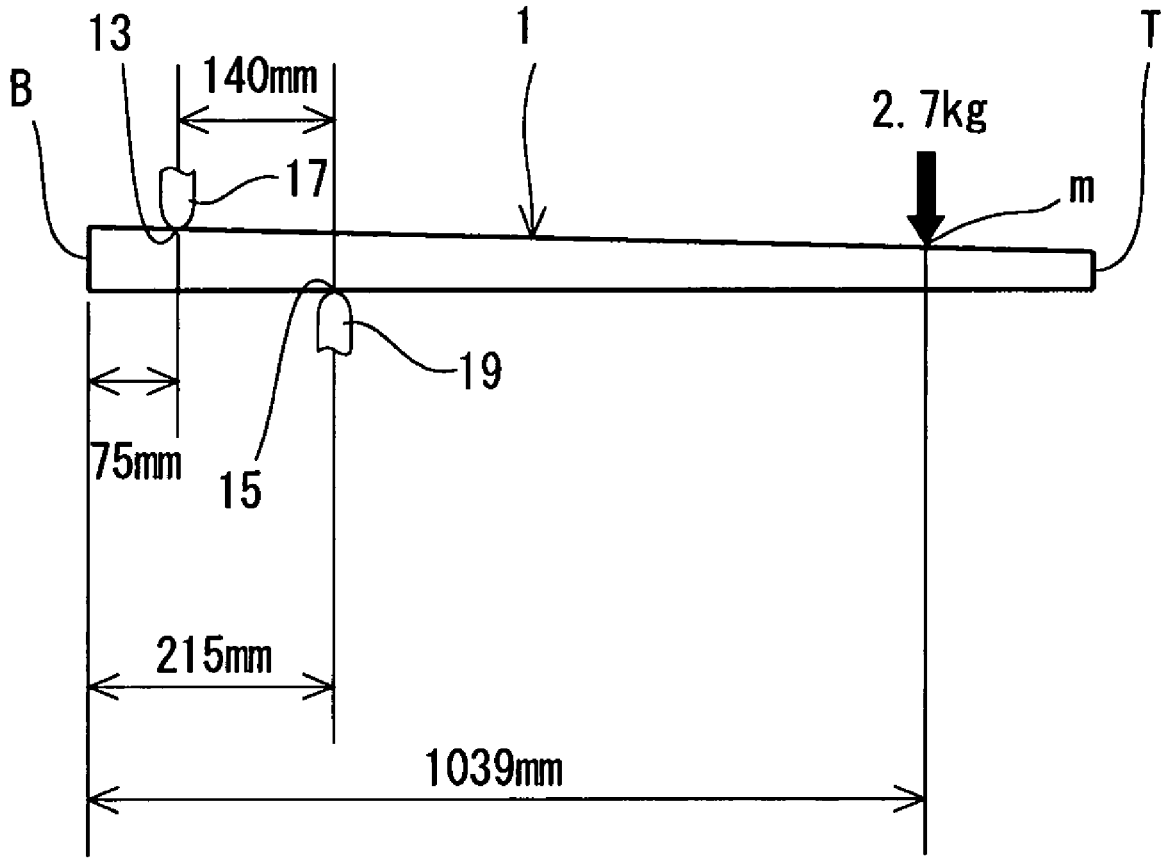
FIG. 5A shows an explanatory view for illustrating a process for measuring forward flex f.

FIG. 5A shows an explanatory view for illustrating a process for measuring forward flex f. As shown in FIG. 5A, first supporting point 13 was set at a position 75 mm away from the grip-side end B. Further, the second supporting point 15 was set at a position 215 mm away from the grip-side end B. At the first supporting point 13 was provided a support 17 that supported the shaft 1 from above. At the second supporting point 15 was provided a support 19 that supported the shaft 1 from beneath. In the state in which there is no load, the shaft axis line of the shaft 1 was substantially horizontal. At a weight point m that is positioned 1039 mm away from the grip-side end B, a load of 2.7 kg was allowed to act in a vertical downward direction. A travel distance (mm) to the weight point m from the state in which there was no load to the state in which a load was applied was determined as the forward flex f. This travel distance is a distance of the movement along the vertical direction.

Cross-sectional shape of a part of the support 17 to be brought into contact with the shaft (hereinafter, referred to as contact part) is as follows. In a cross section that is parallel to the shaft axis direction, cross-sectional shape of the contact part of the support 17 has a protruded round shape. Curvature radius of this roundness is 15 mm. In a cross section that is perpendicular to the shaft axis direction, cross-sectional shape of the contact part of the support 17 has a recessed round shape. Curvature radius of this roundness is 40 mm. In a cross section that is perpendicular to the shaft axis direction, the length of the contact part of the support 17 in the horizontal direction (length in the depth direction in FIG. 5A) is 15 mm. Cross-sectional shape of the contact part of the support 19 is the same as that of the support 17. Cross-sectional shape of the contact part of the load indentor (not shown in the Figure) that imparts a load of 2.7 kg at the point m has a protruded roundness in the cross section that is parallel to the shaft axis direction. The curvature radius of this roundness is 10 mm. Cross-sectional shape of the contact part of the load indentor (not shown in the Figure) that imparts a load of 2.7 kg at the point m is linear in the cross section that is perpendicular to the shaft axis direction. This line has a length of 18 mm. Accordingly, the forward flex f was measured.

[Measurement of Backward Flex]

Figure 5B:
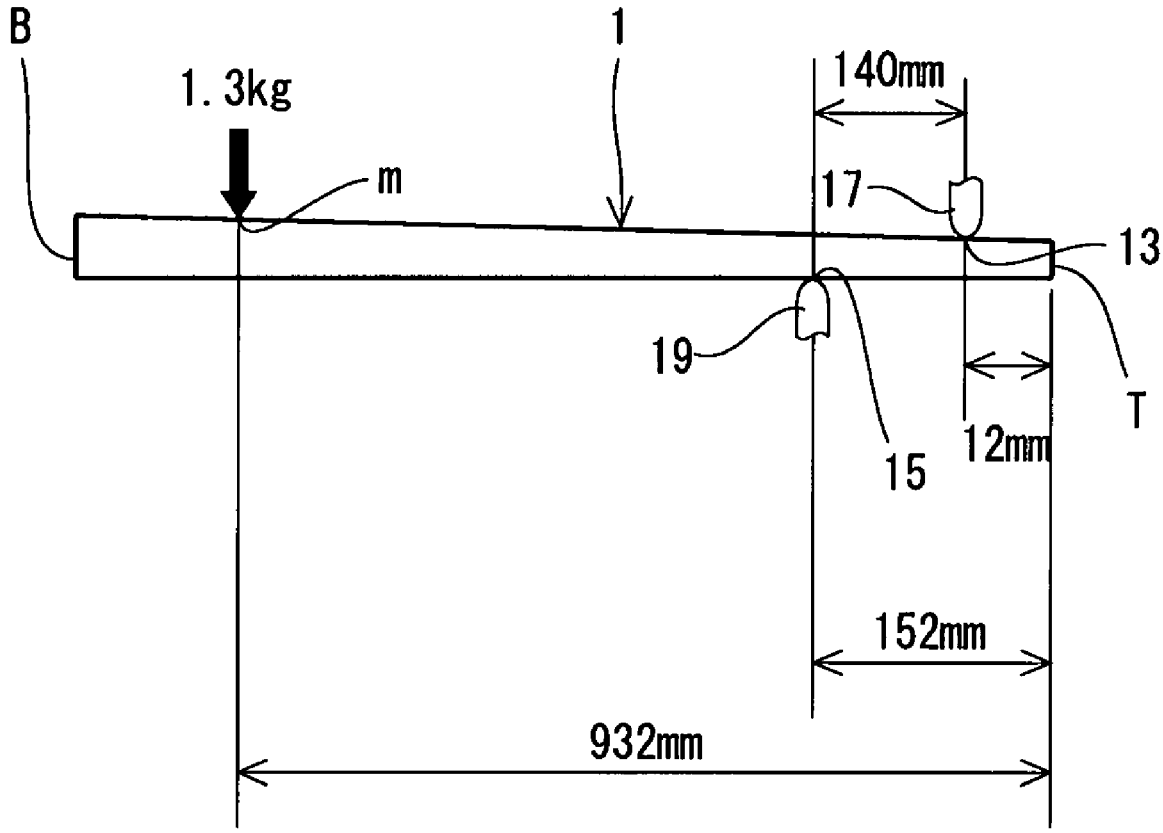
FIG. 5B shows a view for illustrating a process for measuring backward flex.

Backward flex was measured in a similar manner to the forward flex f except that the first supporting point 13 was set at a position 12 mm away from the head-side end T; the second supporting point 15 was set at a position 152 mm away from the head-side end T; the weight point m was set at a position 932 mm away from the head-side end T; and a load of 1.3 kg was employed. The process for measuring this backward flex is illustrated in FIG. 5B.

Example 1

Figure 6A:
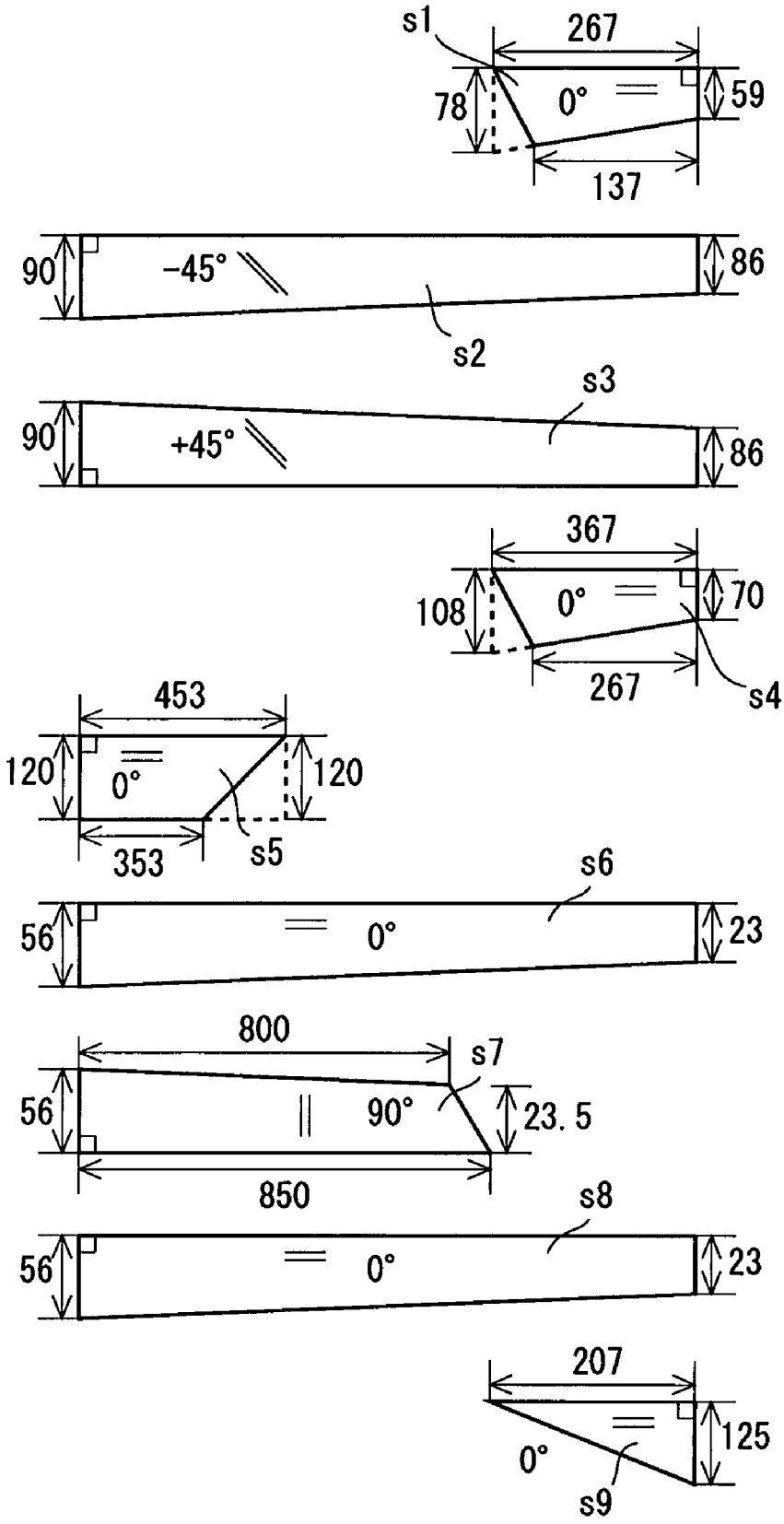

A shaft was manufactured according to a sheet winding method. Multiple pieces of the pre-preg were laminated on a mandrel made of metal by wrapping them. A developed view of thus laminated pre-pregs is shown in FIG. 6A. Nine pre-pregs of pre-preg s1, pre-preg s2, pre-preg s3, pre-preg s4, pre-preg s5, pre-preg s6, pre-preg s7, pre-preg s8, pre-preg s9 were wrapped in this order on the mandrel not shown in the figure. The pre-pregs shown on the upper side in FIG. 6A are laminated on the inner side.

The pre-preg s1 forms a layer that reinforces the tip part. In the pre-preg s1, fiber orientation angle is substantially parallel (0 degree) to the shaft axis line. In other words, the pre-preg s1 constructs a straight layer. The pre-preg s2 is provided along the overall length of the shaft. The pre-preg s2 forms a so called bias layer. In the pre-preg s2, the fiber orientation angle is substantially −45 degree with respect to the shaft axis line. The pre-preg s3 is also provided along the overall length of the shaft. The pre-preg s3 forms a so called bias layer. In the pre-preg s3, the fiber orientation angle is substantially +45 degree with respect to the shaft axis line. The pre-preg s3 and the pre-preg s4 are overlaid with each other, and wrapped in such a state. When the pre-preg s3 and the pre-preg s4 are overlaid, the pre-preg s3 is turned inside out from the state shown in FIG. 6A. By thus turning inside out, the fiber orientation angles of the pre-preg s2 and the pre-preg s3 are opposed in directions one another.

The pre-preg s4 forms a reinforcing layer that reinforces the tip part. In the pre-preg s4, the fiber orientation angle is substantially parallel to the shaft axis line. In other words, the pre-preg s4 constructs a straight layer. The pre-preg s5 forms a layer that reinforces the rear end. In the pre-preg s5, the fiber orientation angle is substantially parallel to the shaft axis line. In other words, the pre-preg s5 constructs a straight layer. The pre-preg s6 is provided along the overall length of the shaft. In the pre-preg s6, the fiber orientation angle is substantially parallel to the shaft axis line. In other words, the pre-preg s6 constructs a straight layer. The pre-preg s7 is provided only on a part close to the grip-side end B of the shaft. In the pre-preg s7, the orientation angle of the fiber is substantially orthogonal (90 degrees) with respect to the shaft axis line. Accordingly, the pre-preg s7 corresponds to the hoop layer. Provided that the distance from the grip-side end B in the shaft longitudinal direction is defined as Lb, the pre-preg s7 is disposed in the range of Lb from 0 mm to 850 mm. Also, in the area of Lb being from 0 mm to 800 mm, the pre-preg s7 is wrapped once.

The pre-preg s8 is provided along the overall length of the shaft. In the pre-preg s8, the fiber orientation angle is substantially parallel to the shaft axis line. In other words, the pre-preg s8 constructs a straight layer. The pre-preg s9 forms a reinforcing layer that reinforces the tip part. In the pre-preg s9, the fiber orientation angle is substantially parallel to the shaft axis line. In other words, the pre-preg s9 constructs the straight layer. Size of each of the pre-pregs s1 to s9 is as shown in FIG. 6A. This size is represented by a unit of mm.

Brand names (trade name) of the pre-pregs used for the pre-preg s1 to pre-preg s9, and modulus of elasticity of the carbon fiber are shown in the following Table 2. Any of the brand names shown in Table 2 is that of the pre-preg manufactured by Toray Industries, Inc. Number such as "-7" added at the end of the trade name of the pre-pregs indicates the index of fiber weight per $m^2$. Specifically, "-7" indicates that the fiber weight per $m^2$ is 75 g. "-3" indicates that the fiber weight per $m^2$ is 30 g. "-10" and "-11" indicate that the fiber weight per $m^2$ is 100 g; "-12" indicates that the fiber weight per $m^2$ is 125 g; and "-15" indicates that the fiber weight per $m^2$ is 150 g. For example, in "3255G-12", the used carbon fiber has a tensile modulus of elasticity of about 24 $t/mm^2$, and a fiber weight per $m^2$ of 125 g. In all brands shown in Table 2, the matrix resin is an epoxy resin.

Among the pre-pregs s1 to s9, the high-strength straight layer corresponds to the pre-preg s6 and the pre-preg s8. The pre-preg s6 and the pre-preg s8 are provided along the overall length of the shaft. In Example 1, two high-strength straight layers are provided. Between the two high-strength straight layers, the pre-preg s7 as a hoop layer is interposed. The hoop layer s7 is provided adjacent to the straight layer s8 provided along the shaft overall length, and below the straight layer s8. By providing the straight layer s8 on the external side of the hoop layer s7, grinding of the hoop layer s7 can be avoided in the grinding step of the surface of the shaft. On the other hand, by providing the hoop layer s7 so as to be adjacent to the outermost layer, the hoop layer s7 can be positioned at the more outer layer side. By providing the hoop layer s7 to the outer layer side, the diameter of the hoop layer s7 becomes large, whereby the effect of suppressing the collapse can be promoted. Moreover, by providing the hoop layer s7 to the outer layer side, the diameter of the hoop layer s7 becomes large, whereby the effect of accelerating the recovery from the bending can be promoted.

The pre-preg s8 that corresponds to the high-strength straight layer constitutes the outermost layer among the layers provided along the shaft overall length. According to this constitution, the effect of enhancing the strength due to the high-strength straight layer can be promoted. In Example 1, the straight layers provided along the shaft overall length are all high-strength straight layers. According to this constitution, the effect of enhancing the strength due to the high-strength straight layer can be promoted.

A polypropylene tape was wrapped on the external side of thus laminated pre-pregs s1 to s9. It was then heated and compressed in an oven to allow the resin to be molded while curing. From the molded product taken out from the oven, the mandrel was pulled out. Both ends were cut in order to make the length uniform, followed by carrying out the surface grinding to obtain the shaft according to Example 1. To this shaft were attached a head and a grip, whereby the golf club according to the Example 1 was obtained. As the head, "SRIXON W-505, loft: 10.5 degree" manufactured by SRI Sports, Inc., was used.

Example 2

Shaft and golf club according to Example 2 were obtained in a similar manner to Example 1 except that brands and constructions of the pre-pregs s1 to s9 were as shown in Table 2.

Comparative Examples 1 to 5

Shaft and golf club according to Comparative Examples 1 to 5 were obtained in a similar manner to Example 1 except that brands and constructions of the pre-pregs s1 to s9 were as shown in Table 2. In Comparative Example 1, the pre-preg s8 was not used. In Comparative Example 2, the pre-preg s4 and the pre-preg s5 were not used. In Comparative Example 5, the hoop layer was not used. Comparative Example 5 is similar to Example 1 except that the fiber orientation angle of the pre-preg s7 was 0 degree.

Specifications of Examples 1 and 2, and Comparative Examples 1 to 5, and results of evaluation thereof are shown in the following Table 3 to Table 5. The process for measuring the flexural rigidity EI was as described above.

Figure 7A:
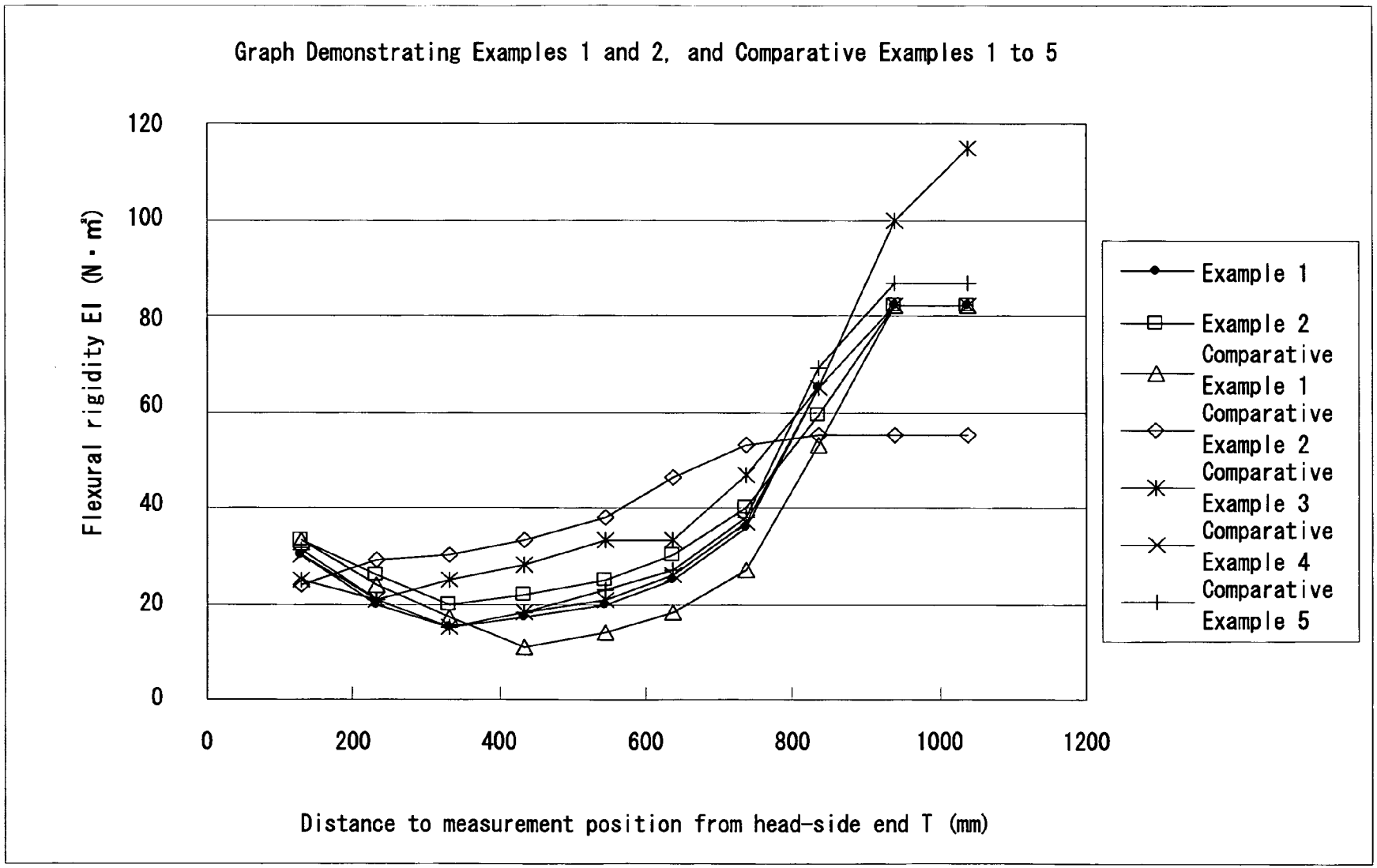
FIG. 7A shows a graph demonstrating Examples 1 and 2, and Comparative Examples 1 to 5.

FIG. 7A shows line graphs drawn by plotting from T1 to T10 and connecting them in Examples 1 and 2, and Comparative Examples 1 to 5, respectively.

Example 3

Figure 6B:
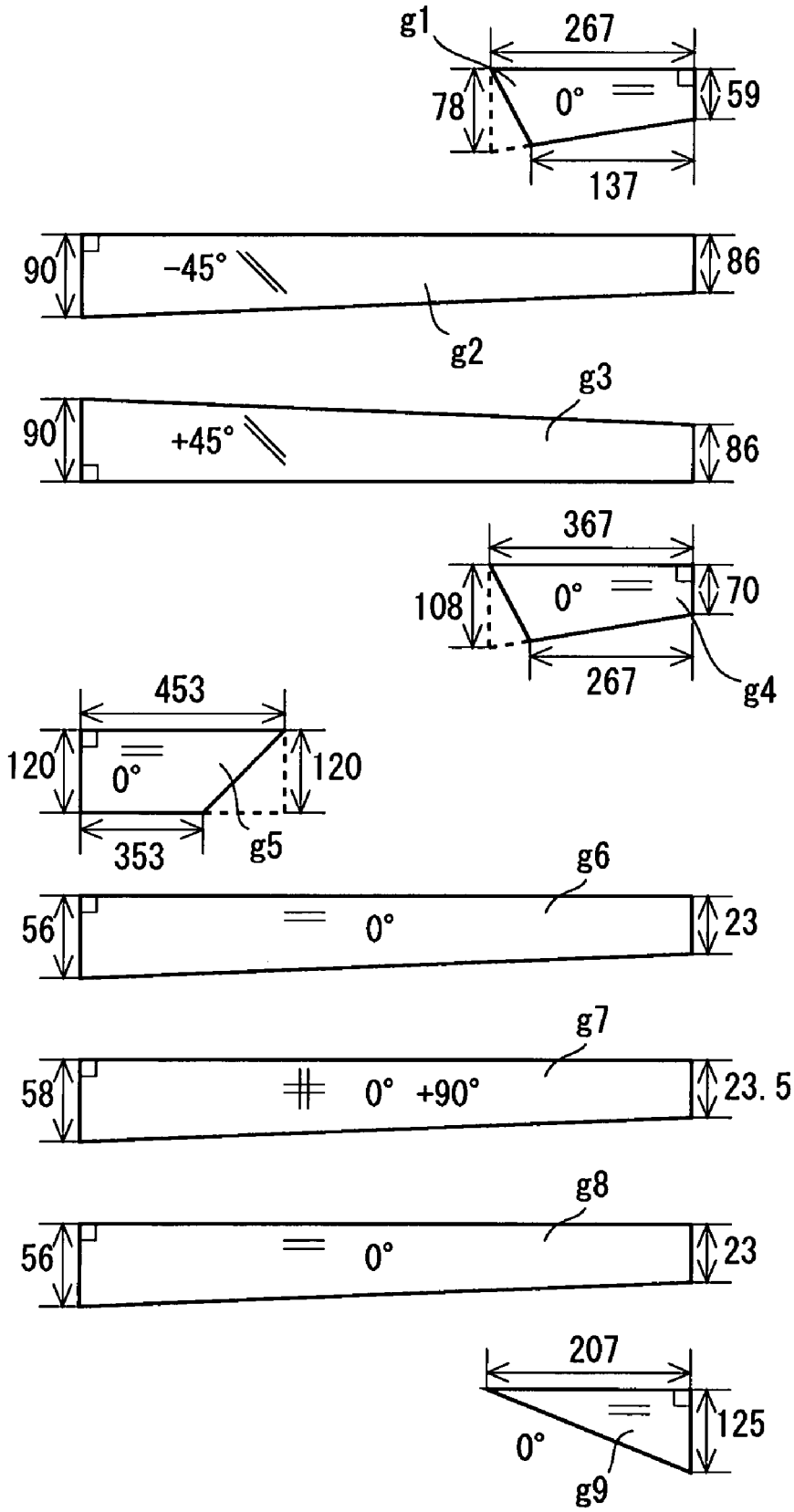

A shaft was manufactured according to the sheet winding method. Multiple pieces of the pre-preg were laminated on a mandrel made of metal by wrapping them. A developed view of thus laminated pre-pregs is shown in FIG. 6B. Nine pre-pregs of pre-preg g1, pre-preg g2, pre-preg g3, pre-preg g4, pre-preg g5, pre-preg g6, pre-preg g7, pre-preg g8, pre-preg g9 were wrapped in this order on the mandrel not shown in the figure. The pre-pregs shown on the upper side in FIG. 6B are laminated on the inner side.

The pre-preg g1 forms a layer that reinforces the tip part. In the pre-preg g1, fiber orientation angle is substantially parallel (0 degree) to the shaft axis line. In other words, the pre-preg g1 constructs a straight layer. The pre-preg g2 is provided along the overall length of the shaft. The pre-preg g2 forms a so called bias layer. In the pre-preg g2, the fiber orientation angle is substantially −45 degree with respect to the shaft axis line. The pre-preg g3 is also provided along the overall length of the shaft. The pre-preg g3 forms a so called bias layer. In the pre-preg g3, the fiber orientation angle is substantially +45 degree with respect to the shaft axis line. The pre-preg g3 and the pre-preg g4 are overlaid with each other, and wrapped in such a state. When the pre-preg g3 and the pre-preg g4 are overlaid, the pre-preg g3 is turned inside out from the state shown in FIG. 6B. By thus turning inside out, the fiber orientation angles of the pre-preg g2 and the pre-preg g3 are opposed in directions one another.

The pre-preg g4 forms a reinforcing layer that reinforces the tip part. In the pre-preg g4, the fiber orientation angle is substantially parallel to the shaft axis line. In other words, the pre-preg g4 constructs a straight layer. The pre-preg g5 forms a layer that reinforces the rear end. In the pre-preg g5, the fiber orientation angle is substantially parallel to the shaft axis line. In other words, the pre-preg g5 constructs a straight layer. The pre-preg g6 is provided along the overall length of the shaft. The pre-preg g6 forms a high-strength straight layer. In the pre-preg g6, the fiber orientation angle is substantially parallel to the shaft axis line. In other words, the pre-preg g6 constructs a straight layer.

The pre-preg g7 is a textile pre-preg. The pre-preg g7 includes a plain-woven textile. The pre-preg g7 is provided along the overall length of the shaft. The pre-preg g7 has a warp and a weft. One of the warp and weft is oriented substantially to the shaft axis direction. One of the warp and weft is a fiber in the axis direction. Another of the warp and weft is oriented substantially to the orthogonal direction with respect to the shaft axis direction. Another of the warp and weft is a fiber in the circumferential direction.

The pre-preg g8 is provided along the overall length of the shaft. In the pre-preg g8, the fiber orientation angle is substantially parallel to the shaft axis line. In other words, the pre-preg g8 constructs a straight layer. The pre-preg g8 forms a high-strength straight layer. The pre-preg g9 forms a reinforcing layer that reinforces the tip part. In the pre-preg g9, the fiber orientation angle is substantially parallel to the shaft axis line. In other words, the pre-preg g9 constructs the straight layer. Size of each of the pre-pregs g1 to g9 is as shown in FIG. 6B. This size is represented by a unit of mm.

Brand names (trade name) of the pre-pregs used for the pre-preg g1 to pre-preg g9, and modulus of elasticity of the carbon fiber are shown in the following Table 6. Any of the brand names shown in Table 6 is that of the pre-preg manufactured by Toray Industries, Inc., or manufactured by Mitsubishi Rayon Co., Ltd. At the end of the trade name of the pre-preg manufactured by Toray Industries, Inc., hyphen and a numeral are added. The numeral such as "-7" indicates the index of fiber weight per $m^2$. Specifically, "-7" indicates that the fiber weight per $m^2$ is 75 g. "-3" indicates that the fiber weight per $m^2$ is 30 g. "-10" and "-11" indicate that the fiber weight per $m^2$ is 100 g; "-12" indicates that the fiber weight per $m^2$ is 125 g; and "-15" indicates that the fiber weight per m2 is 150 g. For example, in "3255G-12", the used carbon fiber has a tensile modulus of elasticity of about 24 t/$mm^2$, and a fiber weight per $m^2$ of 125 g. In all brands shown in Table 6, the matrix resin is an epoxy resin.

Among the pre-pregs g1 to g9, the textile layer corresponds to the pre-preg g7. The pre-preg g7 is provided along the overall length of the shaft. By providing the straight layer g8 on the external side of the textile layer g7, grinding of the textile layer g7 can be avoided in the grinding step of the surface of the shaft. On the other hand, by providing the textile layer g7 so as to be adjacent to the outermost layer, the textile layer g7 can be positioned at the more outer layer side. By providing the textile layer g7 to the outer layer side, the diameter of the textile layer g7 becomes large, whereby the effect of suppressing the collapse can be promoted.

A polypropylene tape was wrapped on the external side of thus laminated pre-pregs g1 to g9. It was then heated and compressed in an oven to allow the resin to be molded while curing. From the molded product taken out from the oven, the mandrel was pulled out. Both ends were cut in order to make the length uniform, followed by carrying out the surface grinding to obtain the shaft according to Example 3. To this shaft were attached a head and a grip, whereby the golf club according to the Example 3 was obtained. As the head, "SRIXON W-505, loft: 10.5 degree" manufactured by SRI Sports, Inc., was used.

Example 4

Shaft and golf club according to Example 4 were obtained in a similar manner to Example 3 except that brands and constructions of the pre-pregs g1 to g9 were as shown in Table 6.

In TR3110M used in Example 4, brand name of the warp and weft is "TR30S 3L". This "3L" means that it is a carbon fiber bundle having number of the filaments being 3000. Density of TR3110M (filament number in carbon fiber bundle/25 mm) is 12.5 in the warp, and is also 12.5 in the weft. Weight of TR3110M is 200 (g/$m^2$), and the thickness is 0.23 mm.

In TR1100M used in Example 3, brand name of the warp and weft is "TR40 1L". This "1L" means that it is a carbon fiber bundle having number of the filaments being 1000. Density of TR1100M (filament number in carbon fiber bundle/25 mm) is 17.5 in the warp, and is also 17.5 in the weft. Weight of TR1100M is 95 (g/$m^2$), and the thickness is 0.12 mm.

Comparative Examples 6 to 11

Shaft and golf club according to Comparative Examples 6 to 11 were obtained in a similar manner to Example 3 except that brands and constructions of the pre-pregs g1 to g9 were as shown in Table 6. In Comparative Example 6, the pre-preg g5, the pre-preg g7 and the pre-preg g8 were not used. In Comparative Example 7, the pre-preg g4 and the pre-preg g5 were not used. Comparative Example 10 is similar to Example 3 except that the pre-preg g7 was used as the hoop layer. Comparative Example 11 is similar to Example 3 except that the pre-preg g7 was not used.

Specifications of Examples 3 and 4 and Comparative Examples 6 to 11, and results of evaluation thereof are shown in the following Table 7 to Table 9. The process for measuring the flexural rigidity EI was as described above.

Figure 7B:
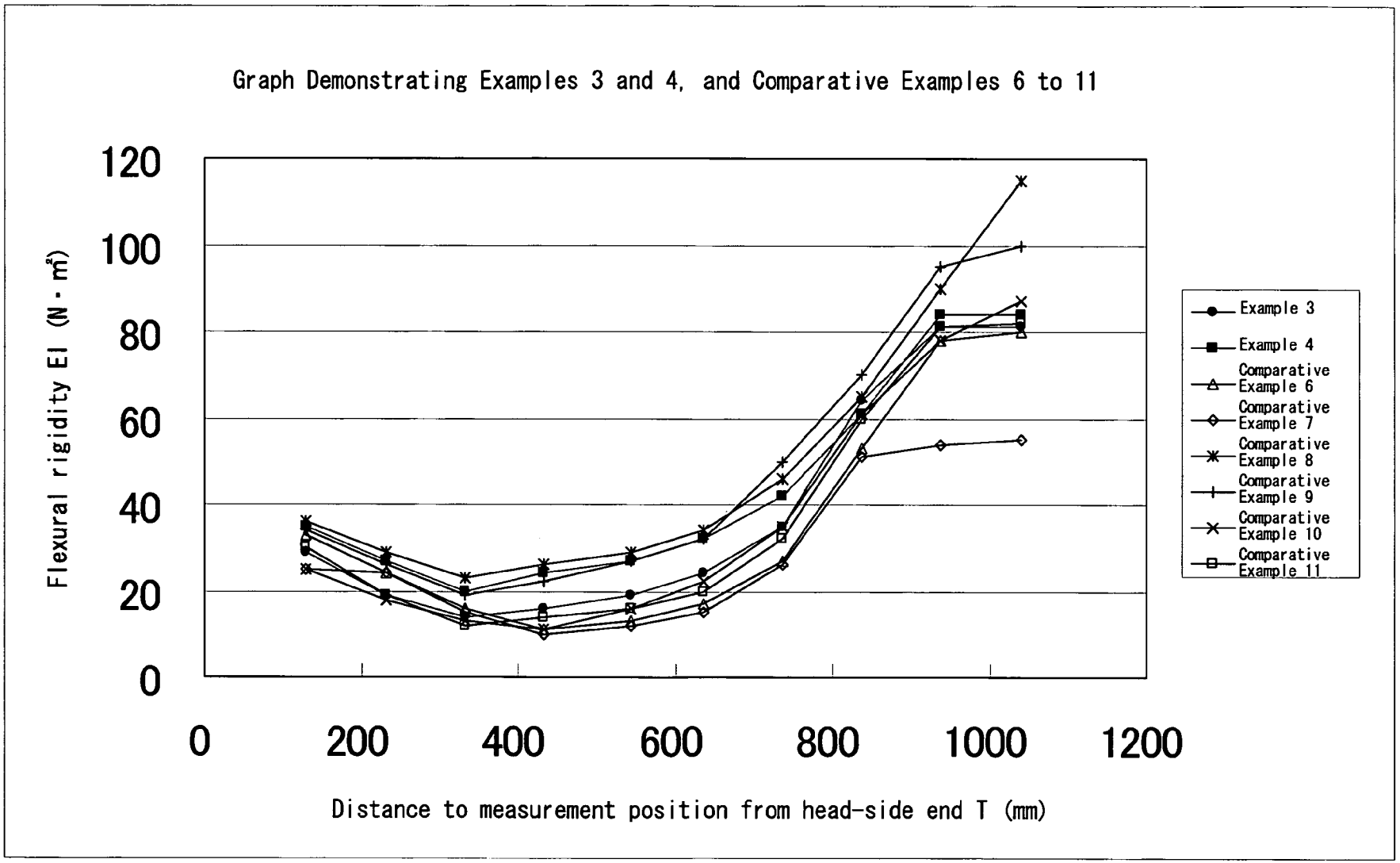
FIG. 7B shows a graph demonstrating Examples 3 and 4, and Comparative Examples 6 to 11.

FIG. 7B shows line graphs drawn by plotting from T1 to T10 and connecting them in Examples 3 and 4 and Comparative Examples 6 to 11, respectively.

Results of evaluation through practical hitting of the balls will be explained below. As shown in Table 3 and Table 7, four items of the evaluation by the actual hitting are as follows: "head speed", launch angle", flight distance", and feeling".

Twenty testers hit 10 golf balls by each golf club, and all these data were averaged to obtain the data of the "head speed", the "launch angle", the "flight distance", and the "feeling". Handicap of the twenty testers is in the range of 20 or greater and 35 or less. These data are shown in the following Table 2. The golf ball used was commercially available three-piece ball, "HI-BRID Everio" (registered trade name) manufactured by SRI Sports, Inc. The "flight distance" was a distance in the direction between the position where the ball was hit and the target position. Each tester gave the evaluation scores according to the following criteria, and average of evaluation scores by ten golf players was determined as the evaluation value of the "feeling". As the evaluation value is closer to the score 3, more favorable result is suggested.

1) Feeling of the shaft being extremely hard: score 1;
2) feeling of the shaft being somewhat hard: score 2;
3) hardness of the shaft being desirable: score 3;
4) feeling of the shaft being somewhat soft: score 4; and
5) feeling of the shaft being extremely soft: score 5.

TABLE 2

Brand of pre-preg used in Examples and Comparative Examples

| | | Example 1 | | Example 2 | | Comparative Example 1 | | Comparative Example 2 | |
|---|---|---|---|---|---|---|---|---|---|
| | | Fiber modulus of elasticity and brand name | Fiber orientation angle | Fiber modulus of elasticity and brand name | Fiber orientation angle | Fiber modulus of elasticity and brand name | Fiber orientation angle | Fiber modulus of elasticity and brand name | Fiber orientation angle |
| s1 | Fiber modulus of elasticity | 24t | 0° | 24t | 0° | 24t | 0° | 24t | 0° |
| | Brand name | 3255G-12 | | 3255G-12 | | 3255G-12 | | 3255G-12 | |
| s2 | Fiber modulus of elasticity | 40t | −45° | 30t | −45° | 30t | −45° | 40t | −45° |
| | Brand name | 9255S-7 | | 2255F-10 | | 2255F-10 | | 9255S-7 | |
| s3 | Fiber modulus of elasticity | 40t | +45° | 30t | +45° | 30t | +45° | 40t | +45° |
| | Brand name | 9255S-7 | | 2255F-10 | | 2255F-10 | | 9255S-7 | |
| s4 | Fiber modulus of elasticity | 24t | 0° | 24t | 0° | 24t | 0° | — | |
| | Brand name | 3255G-10 | | 3255G-10 | | 3255G-10 | | | |

TABLE 2-continued

| Brand of pre-preg used in Examples and Comparative Examples | | | | | | | | | |
|---|---|---|---|---|---|---|---|---|---|
| s5 | Fiber modulus of elasticity | 40t | 0° | 40t | 0° | 50t | 0° | — | |
| | Brand name | 9255S-11 | | 9255S-11 | | 11055F-11 | | | |
| s6 | Fiber modulus of elasticity | 30t | 0° | 30t | 0° | 30t | 0° | 30t | 0° |
| | Brand name | 2255G-12 | | 2255G-12 | | 2255G-12 | | 2255G-15 | |
| s7 | Fiber modulus of elasticity | 30t | 90° | 30t | 90° | 30t | 90° | 30t | 90° |
| | Brand name | 805S-3 | | 805S-3 | | 805S-3 | | 805S-3 | |
| s8 | Fiber modulus of elasticity | 30t | 0° | 30t | 0° | — | | 30t | 0° |
| | Brand name | 2255G-10 | | 2255G-15 | | | | 2255G-15 | |
| s9 | Fiber modulus of elasticity | 24t | 0° | 24t | 0° | 24t | 0° | 24t | 0° |
| | Brand name | 3255G-10 | | 3255G-10 | | 3255G-10 | | 3255G-10 | |

| | | Comparative Example 3 | | Comparative Example 4 | | Comparative Example 5 | |
|---|---|---|---|---|---|---|---|
| | | Fiber modulus of elasticity and brand name | Fiber orientation angle | Fiber modulus of elasticity and brand name | Fiber orientation angle | Fiber modulus of elasticity and brand name | Fiber orientation angle |
| s1 | Fiber modulus of elasticity | 24t | 0° | 24t | 0° | 24t | 0° |
| | Brand name | 3255G-10 | | 3255G-12 | | 3255G-12 | |
| s2 | Fiber modulus of elasticity | 40t | −45° | 40t | −45° | 40t | −45° |
| | Brand name | 9255S-7 | | 9255S-7 | | 9255S-7 | |
| s3 | Fiber modulus of elasticity | 40t | +45° | 40t | +45° | 40t | +45° |
| | Brand name | 9255S-7 | | 9255S-7 | | 9255S-7 | |
| s4 | Fiber modulus of elasticity | 24t | 0° | 24t | 0° | 24t | 0° |
| | Brand name | 3255G-10 | | 3255G-10 | | 3255G-10 | |
| s5 | Fiber modulus of elasticity | 50t | 0° | 40t | 0° | 40t | 0° |
| | Brand name | 11055F-11 | | 9255S-11 | | 9255S-11 | |
| s6 | Fiber modulus of elasticity | 30t | 0° | 30t | 0° | 30t | 0° |
| | Brand name | 2255G-15 | | 2255F-12 | | 2255G-12 | |
| s7 | Fiber modulus of elasticity | 30t | 90° | 30t | 90° | 30t | 0° |
| | Brand name | 805S-3 | | 805S-3 | | 805S-3 | |
| s8 | Fiber modulus of elasticity | 30t | 0° | 30t | 0° | 30t | 0° |
| | Brand name | 2255G-15 | | 2255F-10 | | 2255G-10 | |
| s9 | Fiber modulus of elasticity | 24t | 0° | 24t | 0° | 24t | 0° |
| | Brand name | 3255G-10 | | 3255G-10 | | 3255G-10 | |

TABLE 3

Specifications and evaluation results of Examples and Comparative Examples

| | Shaft overall length L mm | Weight g | Forward flex mm | Backward flex mm | Three-point flexural strength point B kgf | Results of actual hitting: head speed m/s | launch angle deg | flight distance yards | feeling |
|---|---|---|---|---|---|---|---|---|---|
| Example 1 | 1169 | 39 | 148 | 120 | 65 | 39.0 | 13.8 | 211 | 3.4 |
| Example 2 | 1169 | 44 | 141 | 118 | 72 | 38.0 | 13.4 | 208 | 3.2 |
| Comparative Example 1 | 1169 | 38 | 162 | 122 | 50 | 37.4 | 13.0 | 198 | 4.1 |
| Comparative Example 2 | 1169 | 48 | 118 | 120 | 70 | 36.6 | 12.3 | 183 | 2.1 |
| Comparative Example 3 | 1169 | 52 | 110 | 116 | 70 | 36.0 | 12.7 | 181 | 2.2 |
| Comparative Example 4 | 1169 | 39 | 147 | 118 | 55 | 39.0 | 13.7 | 210 | 3.2 |
| Comparative Example 5 | 1169 | 39 | 135 | 119 | 78 | 37.1 | 13.1 | 204 | 2.2 |

TABLE 4

Specifications and evaluation results of Examples and Comparative Examples

| | EI(1) | EI(2) | EI(3) | EI(4) | EI(5) | EI(6) | EI(7) | EI(8) | EI(9) | EI(10) | E1 | E2 | E2 − E1 |
|---|---|---|---|---|---|---|---|---|---|---|---|---|---|
| Measurement position (distance from head-side end T; mm) | 130 | 231 | 332 | 433 | 543 | 635 | 736 | 837 | 938 | 1039 | — | — | — |
| Example 1 ($N \cdot m^2$) | 30 | 20 | 15 | 17 | 20 | 25 | 36 | 65 | 82 | 82 | 15 | 36 | 21 |
| Example 2 ($N \cdot m^2$) | 33 | 26 | 20 | 22 | 25 | 30 | 40 | 59 | 82 | 82 | 20 | 40 | 20 |
| Comparative Example 1 ($N \cdot m^2$) | 33 | 24 | 17 | 11 | 14 | 18 | 27 | 53 | 82 | 82 | 11 | 33 | 22 |
| Comparative Example 2 ($N \cdot m^2$) | 24 | 29 | 30 | 33 | 38 | 46 | 53 | 55 | 55 | 55 | 24 | 53 | 29 |
| Comparative Example 3 ($N \cdot m^2$) | 25 | 21 | 25 | 28 | 33 | 33 | 47 | 65 | 100 | 115 | 21 | 47 | 26 |

TABLE 4-continued

Specifications and evaluation results of Examples and Comparative Examples

| | EI(1) | EI(2) | EI(3) | EI(4) | EI(5) | EI(6) | EI(7) | EI(8) | EI(9) | EI(10) | E1 | E2 | E2 − E1 |
|---|---|---|---|---|---|---|---|---|---|---|---|---|---|
| Comparative Example 4 ($N \cdot m^2$) | 30 | 21 | 15 | 18 | 21 | 26 | 37 | 65 | 82 | 82 | 15 | 37 | 22 |
| Comparative Example 5 ($N \cdot m^2$) | 31 | 21 | 15 | 18 | 23 | 27 | 38 | 69 | 87 | 87 | 15 | 38 | 23 |

TABLE 5

Specifications and evaluation results of Examples and Comparative Examples

| Measurement position (distance from head-side end T) | Slope | E.I. Intercept | | | | | | | | | | |
|---|---|---|---|---|---|---|---|---|---|---|---|---|
| | a | b1 | b2 | b3 | b4 | b5 | b6 | b7 | b8 | b9 | b9 − b1 | b1 − bmin |
| Example 1 | 0.0572 | 22.56 | 6.79 | −3.99 | −7.77 | −11.06 | −11.32 | −6.10 | 17.12 | 28.35 | 5.79 | 33.88 |
| Example 2 | 0.0539 | 25.99 | 13.55 | 2.11 | −1.34 | −4.27 | −4.23 | 0.33 | 13.89 | 31.44 | 5.45 | 30.26 |
| Comparative Example 1 | 0.0539 | 25.99 | 11.55 | −0.89 | −12.34 | −15.27 | −16.23 | −12.67 | 7.89 | 31.44 | 5.45 | 42.22 |
| Comparative Example 2 | 0.0341 | 19.57 | 21.12 | 18.68 | 18.23 | 19.48 | 24.35 | 27.90 | 26.46 | 23.01 | 3.44 | 1.34 |
| Comparative Example 3 | 0.0990 | 12.13 | −1.87 | −7.87 | −14.87 | −20.76 | −29.87 | −25.86 | −17.86 | 7.14 | −4.99 | 42.00 |
| Comparative Example 4 | 0.0572 | 22.56 | 7.79 | −3.99 | −6.77 | −10.06 | −10.32 | −5.10 | 17.12 | 28.35 | 5.79 | 32.88 |
| Comparative Example 5 | 0.0616 | 22.99 | 6.77 | −5.45 | −8.67 | −10.45 | −12.12 | −7.34 | 17.44 | 29.22 | 6.23 | 35.11 |

TABLE 6

Brand of pre-preg used in Examples and Comparative Examples

| | | Example 3 | | Example 4 | | Comparative Example 6 | | Comparative Example 7 | |
|---|---|---|---|---|---|---|---|---|---|
| | | Fiber modulus of elasticity and brand name | Fiber orientation angle | Fiber modulus of elasticity and brand name | Fiber orientation angle | Fiber modulus of elasticity and brand name | Fiber orientation angle | Fiber modulus of elasticity and brand name | Fiber orientation angle |
| g1 | Fiber modulus of elasticity | 24t | 0° | 24t | 0° | 24t | 0° | 24t | 0° |
| | Brand name | 3255G-12 | | 3255G-12 | | 3255G-12 | | 3255G-12 | |
| g2 | Fiber modulus of elasticity | 40t | −45° | 30t | −45° | 40t | −45° | 40t | −45° |
| | Brand name | 9255S-7 | | 2255F-10 | | 9255S-7 | | 9255S-7 | |
| g3 | Fiber modulus of elasticity | 40t | +45° | 30t | +45° | 40t | +45° | 40t | +45° |
| | Brand name | 9255S-7 | | 2255F-10 | | 9255S-7 | | 9255S-7 | |
| g4 | Fiber modulus of elasticity | 24t | 0° | 24t | 0° | 24t | 0° | — | |
| | Brand name | 3255G-10 | | 3255G-10 | | 3255G-10 | | | |
| g5 | Fiber modulus of elasticity | 40t | 0° | 40t | 0° | — | | — | |
| | Brand name | 9255S-11 | | 9255S-11 | | | | | |
| g6 | Fiber modulus of elasticity | 30t | 0° | 30t | 0° | 30t | 0° | 30t | 0° |
| | Brand name | 2255G-12 | | 2255G-12 | | 2255G-12 | | 2255G-15 | |
| g7 | Fiber modulus of elasticity | 24t | 0°, 90 | 24t | 0°, 90 | — | | 24t | 0°, 90 |
| | Brand name | TR1100M | | TR3110M | | | | TR1100M | |
| g8 | Fiber modulus of elasticity | 30t | 0° | 30t | 0° | — | | 30t | 0° |
| | Brand name | 2255G-10 | | 2255G-15 | | | | 2255G-15 | |
| g9 | Fiber modulus of elasticity | 24t | 0° | 24t | 0° | 24t | 0° | 24t | 0° |
| | Brand name | 3255G-10 | | 3255G-10 | | 3255G-10 | | 3255G-10 | |

| | | Comparative Example 8 | | Comparative Example 9 | | Comparative Example 10 | | Comparative Example 11 | |
|---|---|---|---|---|---|---|---|---|---|
| | | Fiber modulus of elasticity and brand name | Fiber orientation angle | Fiber modulus of elasticity and brand name | Fiber orientation angle | Fiber modulus of elasticity and brand name | Fiber orientation angle | Fiber modulus of elasticity and brand name | Fiber orientation angle |
| g1 | Fiber modulus of elasticity | 24t | 0° | 24t | 0° | 24t | 0° | 24t | 0° |
| | Brand name | 3255G-10 | | 3255G-12 | | 3255G-12 | | 3255G-12 | |
| g2 | Fiber modulus of elasticity | 40t | −45° | 40t | −45° | 40t | −45° | 40t | −45° |
| | Brand name | 9255S-7 | | 9255S-7 | | 9255S-7 | | 9255S-7 | |
| g3 | Fiber modulus of elasticity | 40t | +45° | 40t | +45° | 40t | +45° | 40t | +45° |
| | Brand name | 9255S-7 | | 9255S-7 | | 9255S-7 | | 9255S-7 | |
| g4 | Fiber modulus of elasticity | 24t | 0° | 24t | 0° | 24t | 0° | 24t | 0° |
| | Brand name | 3255G-10 | | 3255G-10 | | 3255G-10 | | 3255G-10 | |

TABLE 6-continued

| Brand of pre-preg used in Examples and Comparative Examples | | | | | | | | | |
|---|---|---|---|---|---|---|---|---|---|
| g5 | Fiber modulus of elasticity | 50t | 0° | 40t | 0° | 40t | 0° | 40t | 0° |
| | Brand name | 11055F-11 | | 9255S-11 | | 9255S-11 | | 9255S-11 | |
| g6 | Fiber modulus of elasticity | 30t | 0° | 30t | 0° | 30t | 0° | 30t | 0° |
| | Brand name | 2255G-15 | | 2255F-12 | | 2255G-12 | | 2255G-12 | |
| g7 | Fiber modulus of elasticity | 24t | 0°, 90 | 24t | 0°, 90 | 30t | 90° | — | |
| | Brand name | TR1100M | | TR1100M | | 805S-3 | | | |
| g8 | Fiber modulus of elasticity | 30t | 0° | 30t | 0° | 30t | 0° | 30t | 0° |
| | Brand name | 2255G-15 | | 2255F-10 | | 2255G-10 | | 2255G-10 | |
| g9 | Fiber modulus of elasticity | 24t | 0° | 24t | 0° | 24t | 0° | 24t | 0° |
| | Brand name | 3255G-10 | | 3255G-10 | | 3255G-10 | | 3255G-10 | |

TABLE 7

Specifications and evaluation results of Examples and Comparative Examples

| | Shaft overall length L mm | Weight g | Forward flex mm | Backward flex mm | Three-point flexural strength point B kgf | Results of practical hitting: head speed m/s | launch angle deg | flight distance yard | feeling |
|---|---|---|---|---|---|---|---|---|---|
| Example 3 | 1169 | 43 | 145 | 110 | 65 | 40.0 | 13.7 | 217 | 4.0 |
| Example 4 | 1169 | 45 | 138 | 106 | 75 | 39.0 | 13.3 | 214 | 3.1 |
| Comparative Example 6 | 1169 | 40 | 163 | 121 | 48 | 38.4 | 12.9 | 201 | 4.1 |
| Comparative Example 7 | 1169 | 43 | 167 | 119 | 70 | 37.6 | 12.2 | 189 | 2.1 |
| Comparative Example 8 | 1169 | 53 | 148 | 116 | 75 | 37.0 | 12.6 | 187 | 2.4 |
| Comparative Example 9 | 1169 | 48 | 163 | 118 | 54 | 40.0 | 13.8 | 218 | 3.1 |
| Comparative Example 10 | 1169 | 39 | 164 | 119 | 76 | 38.1 | 13.2 | 210 | 2.5 |
| Comparative Example 11 | 1169 | 40 | 158 | 118 | 58 | 37.2 | 12.2 | 198 | 2.0 |

TABLE 8

Specifications and evaluation results of Examples and Comparative Examples

| | Unit | E.I. EI(1) | EI(2) | EI(3) | EI(4) | EI(5) | EI(6) | EI(7) | EI(8) | EI(9) | EI(10) | E1 | E2 | E2 − E1 |
|---|---|---|---|---|---|---|---|---|---|---|---|---|---|---|
| Measurement position (distance from head-side end T) | mm | 130 | 231 | 332 | 433 | 543 | 635 | 736 | 837 | 938 | 1039 | — | — | — |
| Example 3 | $N \cdot m^2$ | 29 | 19 | 14 | 16 | 19 | 24 | 35 | 64 | 81 | 81 | 14 | 35 | 21 |
| Example 4 | $N \cdot m^2$ | 35 | 27 | 20 | 24 | 27 | 32 | 42 | 61 | 84 | 84 | 20 | 42 | 22 |
| Comparative Example 6 | $N \cdot m^2$ | 33 | 24 | 16 | 11 | 13 | 17 | 27 | 53 | 78 | 80 | 11 | 33 | 22 |
| Comparative Example 7 | $N \cdot m^2$ | 25 | 24 | 15 | 10 | 12 | 15 | 26 | 51 | 54 | 55 | 10 | 26 | 16 |
| Comparative Example 8 | $N \cdot m^2$ | 36 | 29 | 23 | 26 | 29 | 34 | 46 | 65 | 90 | 115 | 23 | 46 | 23 |
| Comparative Example 9 | $N \cdot m^2$ | 34 | 26 | 19 | 22 | 27 | 32 | 50 | 70 | 95 | 100 | 19 | 50 | 31 |
| Comparative Example 10 | $N \cdot m^2$ | 25 | 18 | 13 | 11 | 16 | 22 | 35 | 61 | 78 | 87 | 11 | 35 | 24 |
| Comparative Example 11 | $N \cdot m^2$ | 30 | 19 | 12 | 14 | 16 | 20 | 32 | 60 | 81 | 82 | 12 | 32 | 20 |

TABLE 9

Specifications and evaluation results of Examples and Comparative Examples

| | Slope a | Intercept b1 | b2 | b3 | b4 | b5 | b6 | b7 | b8 | b9 | b9 − b1 | bmin | b1 − bmin |
|---|---|---|---|---|---|---|---|---|---|---|---|---|---|
| Example 3 | 0.0572 | 21.56 | 5.79 | −4.99 | −8.77 | −12.06 | −12.33 | −7.10 | 16.12 | 27.34 | 5.78 | −12.33 | 33.89 |
| Example 4 | 0.0539 | 27.99 | 14.55 | 2.10 | 0.66 | −2.27 | −2.23 | 2.33 | 15.88 | 33.44 | 5.45 | −2.27 | 30.26 |
| Comparative Example 6 | 0.0517 | 26.28 | 12.06 | −1.17 | −11.39 | −15.08 | −15.83 | −11.06 | 9.72 | 29.50 | 3.22 | −15.83 | 42.11 |
| Comparative Example 7 | 0.0330 | 20.71 | 16.38 | 4.04 | −4.29 | −5.92 | −5.96 | 1.71 | 23.38 | 23.04 | 2.33 | −5.96 | 26.67 |
| Comparative Example 8 | 0.0869 | 24.70 | 8.92 | −5.85 | −11.63 | −18.19 | −21.19 | −17.96 | −7.74 | 8.48 | −16.22 | −21.19 | 45.89 |
| Comparative Example 9 | 0.0726 | 24.56 | 9.23 | −5.11 | −9.44 | −12.43 | −14.11 | −3.44 | 9.23 | 26.89 | 2.33 | −14.11 | 38.67 |
| Comparative Example 10 | 0.0682 | 16.13 | 2.24 | −9.64 | −18.53 | −21.04 | −21.31 | −15.20 | 3.91 | 14.02 | −2.11 | −21.31 | 37.44 |
| Comparative Example 11 | 0.0572 | 22.56 | 5.79 | −6.99 | −10.77 | −15.06 | −16.33 | −10.10 | 12.12 | 27.34 | 4.78 | −16.33 | 38.89 |

As shown in Tables 2 to 5, more favorable evaluation w as made on Examples 1 and 2 as compared to Comparative Examples 1 to 5. Accordingly, advantages of the present invention (first invention) are clearly indicated by these results of evaluation.

As shown in Tables 6 to 9, more favorable evaluation was made on Examples 3 and 4 as compared to Comparative Examples 6 to 11. Accordingly, advantages of the present invention (second invention) are clearly indicated by these results of evaluation.

The present invention is applicable to all types of golf clubs such as wood golf clubs, iron golf clubs and the like, and shafts thereof.

The description hereinabove is merely for an illustrative example, and various modifications can be made in the scope not to depart from the principles of the present invention.

What is claimed is:

1. A shaft for golf clubs, wherein a position 130 mm away from the head-side end of the shaft is defined as a first position, a position 130 mm away from the grip-side end of the shaft is defined as a tenth position, and positions provided by equally dividing the length between the first position and the tenth position into nine regions are defined as a second position, a third position, a fourth position, a fifth position, a sixth position, a seventh position, an eighth position and a ninth position in this order from the head side;

each flexural rigidity EI measured at ten sites of from the first position to the tenth position is defined as EI (1), EI (2), EI (3), EI (4), EI (5), EI (6), EI (7), EI (8), EI (9) and EI (10) in this order from the head side;

each point obtained by plotting the measurement values at the positions of ten sites on an X-Y coordinate plane, in which the X-axis represents the distance (mm) to the measurement position from the head-side end and the Y-axis represents the value of flexural rigidity EI ($N \cdot m^2$), is defined as T (1), T (2), T (3), T (4), T (5), T (6), T (7), T (8), T (9) and T (10) in this order from the head side;

the formula representing a line K that passes the T (1) and the T (10) on the X-Y coordinate plane is defined as [Y=aX+b1];

the values ($N \cdot m^2$) at the Y-intercepts on the lines that are parallel to the line K and that pass the points of T (2), T (3), T (4), T (5), T (6), T (7), T (8) and T (9), respectively, are defined as b2, b3, b4, b5, b6, b7, b8 and b9, respectively; and the minimum value among the values at the Y-intercepts b2 to b9 is defined as bmin, the following definition is made, the slope "a" of the line K is 0.04 or greater and 0.06 or less, every one of the b3, b4, b5, b6, b7 and b8 is smaller than b1, the bmin is any one of b4, b5, b6 or b7, the value (b1−bmin) is 30 ($N \cdot m^2$) or greater and 40 ($N \cdot m^2$) or less, and the value (b9-b1) is 4 ($N \cdot m^2$) or greater and 15 ($N \cdot m^2$) or less, and wherein the following requirement (A) or (B) is satisfied:

(A): the shaft has at least one straight layer disposed along the overall length thereof, at least one hoop layer disposed along 50% or more of shaft overall length, the straight layer and the hoop layer includes a carbon fiber reinforced resin, tensile strength of the carbon fiber constituting the straight layer is 580 kgf/$mm^2$ or greater and 680 kgf/$mm^2$ or less, and the strength at a point 525 mm away from the head-side end of the shaft with a SG three-point flexural strength being equal to or greater than 60 kgf;

(B) at least one textile layer having warps and wefts of a carbon fiber is provided, one of the warp and weft is oriented substantially to the shaft axis direction, while another of the warp and weft is oriented substantially to the orthogonal direction with respect to the shaft axis direction, and the tensile strength of the carbon fiber constituting the textile layer is 300 kgf/$mm^2$ or greater and 680 kgf/$mm^2$ or less.

2. The shaft for golf clubs according to claim 1, wherein the minimum value among from EI (1) to EI (10) is E1, and that the maximum value among from EI (1) to EI (7) is E2, E1 is EI (2), EI (3), EI (4) or EI (5), the value E1 is 12 ($N \cdot m^2$) or greater and 20 ($N \cdot m^2$) or less, the value (E2−E1) is equal to or less than 30 ($N \cdot m^2$) and the value EI (10) is 60 ($N \cdot m^2$) or greater and 90 ($N \cdot m^2$) or less.

3. The shaft for golf clubs according to claim 1, wherein the overall length of the shaft is equal to or greater than 43 inches, and the shaft weight is 30 g or greater and 50 g or less.

4. The shaft for golf clubs according to claim 1, wherein the forward flex is 120 mm or greater and 160 mm or less.

5. The shaft for golf clubs according to claim 1, wherein the above requirement (B) is satisfied, and the textile of the textile layer is plain-woven.

6. In a golf club comprising a head, a shaft and a grip, wherein that in the shaft:

a position 130 mm away from the head-side end of the shaft is defined as a first position, a position 130 mm away from the grip-side end of the shaft is defined as a tenth position, and positions provided by equally dividing the length between the first position and the tenth position into nine regions are defined as from a second position to a ninth position in this order from the head side;

each flexural rigidity EI measured at ten sites of from the first position to the tenth position is defined as from EI (1) to EI (10) in this order from the head side;

each point obtained by plotting the measurement values at the positions of ten sites on an X-Y coordinate plane, in which the X-axis represents the distance (mm) to the measurement position from the head-side end and the Y-axis represents the value of flexural rigidity EI ($N \cdot m^2$), is defined as from T (1) to T (10) in this order from the head side;

the formula representing a line K that passes the T (1) and the T (10) on the X-Y coordinate plane is defined as [Y=aX+b1];

the values ($N-m^2$) at the Y-intercepts on the lines that are parallel to the line K and that pass the points of from T (2) to T (9), respectively, are defined as from b2 to b9, respectively; and the minimum value among the values at the Y-intercepts b2 to b9 is defined as bmin, the following definition is made, said shaft having the slope "a" of the line K being 0.04 or greater and 0.06 or less, every one of the b3, b4, b5, b6, b7 and b8 being smaller than b1, the bmin being any one of b4, b5, b6 or b7, the value (b1−bmin) being 30 ($N \cdot m^2$) or greater and 40 ($N \cdot m^2$) or less, and the value (b9−b1) being 4 ($N \cdot m^2$) or greater and 15 ($N \cdot m^2$) or less, and wherein the following requirement (A) or (B) is satisfied:

(A): the shaft has at least one straight layer disposed along the overall length thereof, at least one hoop layer disposed along 50% or more of shaft overall length, the straight layer and the hoop layer includes a carbon fiber reinforced resin, tensile strength of the carbon fiber constituting the straight layer is 580 kgf/mm$^2$ or greater and 680 kgf/mm$^2$ or less, and the strength at a point 525 mm away from the head-side end of the shaft with a SG three-point flexural strength being equal to or greater than 60 kgf;

(B) at least one textile layer having warps and wefts of a carbon fiber is provided, one of the warp and weft is oriented substantially to the shaft axis direction, while another of the warp and weft is oriented substantially to the orthogonal direction with respect to the shaft axis direction, and the tensile strength of the carbon fiber constituting the textile layer is 300 kgf/mm$^2$ or greater and 680 kgf/mm$^2$ or less.

* * * * *